US008281881B2

(12) United States Patent
Tedeschi

(10) Patent No.: US 8,281,881 B2
(45) Date of Patent: Oct. 9, 2012

(54) ROLLING CONE DRILL BIT HAVING CUTTING ELEMENTS WITH IMPROVED ORIENTATIONS

(75) Inventor: Luca Tedeschi, Volterra (IT)

(73) Assignee: Smith International, Inc., Houston, TX (US)

( * ) Notice: Subject to any disclaimer, the term of this patent is extended or adjusted under 35 U.S.C. 154(b) by 455 days.

(21) Appl. No.: 12/401,104

(22) Filed: Mar. 10, 2009

(65) Prior Publication Data

US 2009/0229887 A1 Sep. 17, 2009

Related U.S. Application Data

(60) Provisional application No. 61/035,605, filed on Mar. 11, 2008.

(51) Int. Cl.
*E21B 10/36* (2006.01)
*E21B 10/00* (2006.01)

(52) U.S. Cl. ..... 175/374; 175/378; 175/426; 175/430; 175/431

(58) Field of Classification Search ..... 175/57, 175/375, 378, 431, 426, 374, 37
See application file for complete search history.

(56) References Cited

U.S. PATENT DOCUMENTS

| | | | | |
|---|---|---|---|---|
| 4,334,586 | A | 6/1982 | Schumacher | |
| 5,027,913 | A * | 7/1991 | Nguyen | 175/336 |
| 5,201,376 | A * | 4/1993 | Williams | 175/374 |
| 6,095,262 | A * | 8/2000 | Chen | 175/57 |
| 6,161,634 | A * | 12/2000 | Minikus et al. | 175/331 |
| 6,561,293 | B2 * | 5/2003 | Minikus et al. | 175/420.1 |
| 7,699,126 | B2 * | 4/2010 | Boudrare et al. | 175/374 |
| 2003/0079917 | A1 | 5/2003 | Klompenburg et al. | |
| 2006/0260846 | A1 * | 11/2006 | Portwood et al. | 175/331 |
| 2007/0084640 | A1 * | 4/2007 | Singh | 175/331 |

FOREIGN PATENT DOCUMENTS

GB 2438855 12/2007

OTHER PUBLICATIONS

Response to British Examination Report dated Nov. 12, 2009 for Appl. No. GB0904181.5; (21 p.).
Combined Search and Examination Report for appl. No. GB0904181.5 dated Nov. 12, 2009; (6 p.).

* cited by examiner

*Primary Examiner* — Kenneth L Thompson
*Assistant Examiner* — Michael Wills, III
(74) *Attorney, Agent, or Firm* — Christie, Parker & Hale, LLP

(57) ABSTRACT

A rolling cone drill bit for drilling a borehole in earthen formations. In an embodiment, the bit comprises a bit body. In addition, the bit comprises a cone cutter mounted on the bit body and adapted for rotation about a cone axis in a cutting direction. Further, the bit comprises at least one transition insert mounted to the cone cutter. Still further, the bit comprises a first asymmetric insert mounted to the cone cutter. Moreover, the bit comprises a second asymmetric insert mounted to the cone cutter. Each insert includes a cutting surface with a leading side relative to the cutting direction. The leading side of the first asymmetric insert has a leading geometry and the leading side of the second asymmetric insert has a leading geometry that is different than the leading geometry of the first asymmetric insert.

28 Claims, 12 Drawing Sheets

ROLLING CONE DRILL BIT HAVING CUTTING ELEMENTS WITH IMPROVED ORIENTATIONS

CROSS-REFERENCE TO RELATED APPLICATIONS

This application claims benefit of U.S. provisional application Ser. No. 61/035,605 filed Mar. 11, 2008, and entitled "Rolling Cone Drill Bit Having Cutting Elements With Improved Orientations," which is hereby incorporated herein by reference in its entirety for all purposes.

STATEMENT REGARDING FEDERALLY SPONSORED RESEARCH OR DEVELOPMENT

Not Applicable.

BACKGROUND OF THE TECHNOLOGY

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in cutting element orientation so as to improve bit durability and rate of penetration.

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

An earth-boring bit in common use today includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material that are carried upward and out of the borehole by drilling fluid which is pumped downwardly through the drill pipe and out of the bit.

The earth disintegrating action of the rolling cone cutters is enhanced by providing a plurality of cutting elements on the cutters. Cutting elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutting elements on the rotating cutters break up the formation to form the new borehole by a combination of gouging and scraping or chipping and crushing. The shape and positioning of the cutting elements (both steel teeth and tungsten carbide inserts) upon the cone cutters greatly impact bit durability and rate of penetration (ROP) and thus, are important to the success of a particular bit design.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section.

As is thus obvious, this process, known as a "trip" of the drill string, requires considerable time, effort and expense. Because drilling costs are typically thousands of dollars per hour, it is thus always desirable to employ drill bits which will drill faster and longer, and which are usable over a wider range of formation hardness. The length of time that a drill bit may be employed before it must be changed depends upon its ability to "hold gage" (meaning its ability to maintain a full gage borehole diameter), its rate of penetration (ROP), as well as its durability or ability to maintain an acceptable ROP.

The inserts in TCI bits are typically positioned in circumferential rows on the rolling cone cutters. To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutting elements on the bit, and may accelerate wear of the cutter bearings, and ultimately lead to bit failure.

Conventional bits also typically include one or more rows of gage cutting elements. Gage cutting elements are mounted adjacent to the heel surface but orientated and sized in such a manner so as to cut the corner of the borehole. In this orientation, the gage cutting elements generally are required to cut both the borehole bottom and sidewall. The lower surface of the gage cutting elements engages the borehole bottom, while the radially outermost surface scrapes the sidewall of the borehole.

Conventional bits also include a number of additional rows of cutting elements that are located on the cones in rows disposed radially inward from the gage row relative to the bit axis. These cutting elements are sized and configured for cutting the bottom of the borehole and are typically described as inner row cutting elements and, as used herein, may also be described as bottomhole cutting elements. Such cutting elements are intended to penetrate and remove formation material by gouging and fracturing formation material. In many applications, inner row cutting elements are relatively longer and sharper than those typically employed in the gage row or the heel row where the inserts ream the sidewall of the borehole via a scraping or shearing action.

Inner row inserts in TCI bits have been provided with various geometries. The cutting surfaces of some inserts have a symmetric geometry, while the cutting surface of other inserts have an asymmetric geometry. For example, a "conical" insert having a cutting surface that tapers from a cylindrical base to a generally rounded or spherical apex is one common symmetric insert. Such an insert is shown, for example, in FIGS. 4A-C in U.S. Pat. No. 6,241,034. Another common symmetric insert is the semi-round top or domed insert having a spherical cutting surface. On the other hand, a "chisel" crested insert is an example of an asymmetric insert. Rather than having the spherical apex of the conical insert, a chisel insert includes two generally flattened sides or flanks that converge and terminate in an elongate crest at the terminal end of the insert. The chisel element may have rather sharp transitions where the flanks intersect the more rounded portions of the cutting surface, as shown, for example, in FIGS. 1-8 in U.S. Pat. No. 5,172,779. Other common asymmetric inserts include a crest or apex that is offset from the insert's axis, or having cutting surfaces that vary in geometry about the circumference of the cutting portion of the insert.

By rotating an asymmetric insert about its central axis when it is mounted to the rolling cone cutter, the geometry of the leading side of the insert may be varied. As used herein, the term "leading" may be used to describe a side, half, or particular region of the cutting surface of an insert that leads the insert relative to a particular direction of motion (e.g., direction of rotation of the cone cutter to which the insert is mounted), whereas the term "trailing" may be used to describe a side, half, or particular region of the cutting surface of an insert that trails or follows the leading side relative to that particular direction of motion. In other words, for a given direction of motion, the leading side of the insert faces the direction of direction of motion and the trailing side faces away from the direction of motion. For a given direction of motion, the trailing side of an insert is generally disposed opposite or 180° from the leading side. Depending on the application and the type of formation to be drilled, it may be preferred to orient an insert such that a particular portion or side of the insert first impacts the formation during drilling. For instance, some asymmetric inserts are designed to include cutting surfaces with particular regions designed and tailored to impact the formation, and break, crush, and shear the formation material, and other regions designed and tailored to trail and support the impacting portion of the insert, and scrape across the newly exposed formation material.

In many conventional rolling cone bits, the inserts on each given cone cutter are mounted in substantially identical orientations relative to the direction of rotation of the cone cutter about the cone axis. In other words, each insert is oriented such that the same region or portion of the cutting surface is disposed on the leading side of the insert relative to the direction of rotation of the cone cutter. This approach generally assumes that all the inserts on a given cone move in the same direction—the direction of rotation of the cone cutter about the cone axis. However, when the rotation of the entire bit about the central axis of the drill string is taken into account along with the rotation of the individual rolling cone cutters about their respective cone axis, inserts mounted in different regions of a given cone cutter actually move in opposite directions relative to each other. In particular, the combined effect of the bit rotation and the cone rotation results in the radially innermost inserts (relative to the bit axis) on a given cone moving in a first direction, whereas the radially outermost inserts (relative to the bit axis) on same cone move in a second direction generally opposite the first direction. With identical and uniform insert orientations in the cone cutter relative to the direction of rotation of the cone about the cone axis, the geometry of the portion of the cutting surface of the radially innermost inserts that leads the insert into the formation during drilling may be different than the geometry of the portion of the cutting surface of the radially outermost inserts that leads the insert into the formation. Those regions of the cutting surface that are not specifically designed or tailored to impact and lead the insert into the formation during drilling may be particularly susceptible to premature chipping, breaking, or damage. Once the cutting structure is damaged and the ROP is reduced to an unacceptable rate, the drill string must be removed in order to replace the drill bit. As mentioned, this "trip" of the drill string is extremely time consuming and expensive to the driller. Likewise, since the regions of the cutting surface designed or tailored to be disposed on the trailing side of the insert relative to the direction of impact with the formation are generally less proficient at removing formation material, inserts oriented in such a manner may detrimentally reduce the cutting efficiency and ROP of the bit.

Accordingly, there remains a need in the art for a drill bit with cutting elements that will provide a relatively high rate of penetration and footage drilled, while at the same time, minimize the effects of wear and the tendency for breakage. Such bits would be particularly well received if the orientation and placement of the individual cutting elements accounted for the kinematics of the entire bit (i.e., rotation of the bit about the bit axis in conjunction with the rotation of the rolling cone cutters about their respective cone axes).

BRIEF SUMMARY OF SOME OF THE PREFERRED EMBODIMENTS

These and other needs in the art are addressed in one embodiment by a rolling cone drill bit for drilling a borehole in earthen formations. In an embodiment, the bit comprises a bit body having a bit axis. In addition, the bit comprises a rolling cone cutter mounted on the bit body and adapted for rotation about a cone axis in a cutting direction. Further, the bit comprises at least one transition insert mounted to the cone cutter at a first radial position relative to the bit axis. Still further, the bit comprises a first asymmetric insert mounted to the cone cutter at the first radial position or radially inward of the first radial position relative to the bit axis. Moreover, the bit comprises a second asymmetric insert mounted to the cone cutter at a second radial position that is radially outward of the first radial position relative to the bit axis. Each insert includes a base portion having a central axis and a cutting portion extending from the base portion and including a cutting surface. The cutting surface of the first asymmetric insert has a leading side relative to the cutting direction with a leading geometry and the cutting surface of the second asymmetric insert has a leading side relative to the cutting direction with a leading geometry that is different than the leading geometry of the first asymmetric insert.

These and other needs in the art are addressed in another embodiment by a method of orienting cutting elements on a cone cutter of a drill bit. In an embodiment, the method comprises providing a bit body having a bit axis. In addition, the method comprises mounting a rolling cone cutter on the bit body, the rolling cone cutter adapted for rotation about a cone axis in a cutting direction. Further, the method comprises inserting a plurality of inserts into the cone cutter, wherein the plurality of inserts are arranged in a plurality of circumferential rows that are axially spaced relative to the cone axis, wherein each insert has a base portion secured in a mating socket of the cone cutter and a cutting portion extending from the base portion, wherein the base portion has a central axis and the cutting portion has a cutting surface. Still further, the method comprises identifying a transition insert on the cone cutter, the transition insert being disposed at a first radial position. A first of the plurality of inserts is an asymmetric insert disposed at the first radial position or radially inward of the first radial position relative to the bit axis, and a second of the plurality of inserts is an asymmetric insert disposed radially outward of the first radial position relative to the bit axis. Moreover, the method comprises orienting the first of the plurality of inserts such that its cutting surface has a leading side relative to the cutting direction with a first geometry. Further, the method comprises orienting the second of the plurality of inserts such that its cutting surface has a leading side relative to the cutting direction with a second geometry that is different than the first geometry.

These and other needs in the art are addressed in another embodiment by a rolling cone drill bit for drilling a borehole in earthen formations. In an embodiment, the bit comprises a bit body having a bit axis. In addition, the bit comprises a rolling cone cutter mounted on the bit body and adapted for rotation about a cone axis in a cutting direction. Further, the bit comprises at least one transition insert mounted to the cone cutter at a first radial position relative to the bit axis. Still further, the bit comprises a first insert having a central axis and being mounted to the cone cutter at the first radial position or radially inward of the first radial position relative to the bit axis. The central axis of the first insert defines a first insert axis plane that is parallel to the cone axis, wherein the cone axis defines a first cone axis plane that is parallel to the first insert axis plane, and wherein the first insert axis plane is offset from the first cone axis plane by a first offset distance measured perpendicularly therebetween. Moreover, the bit comprises a second insert having a central axis and being mounted to the cone cutter radially outward of the first radial position relative to the bit axis. The central axis of the second insert defines a second insert axis plane that is parallel to the cone axis, wherein the cone axis defines a second cone axis plane that is parallel to the second insert axis plane, and wherein the second insert axis plane is offset from the second cone axis plane by a second offset distance measured perpendicularly therebetween. The first offset distance is different than the second offset distance.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF SOME OF THE PREFERRED EMBODIMENTS

Figure 1:
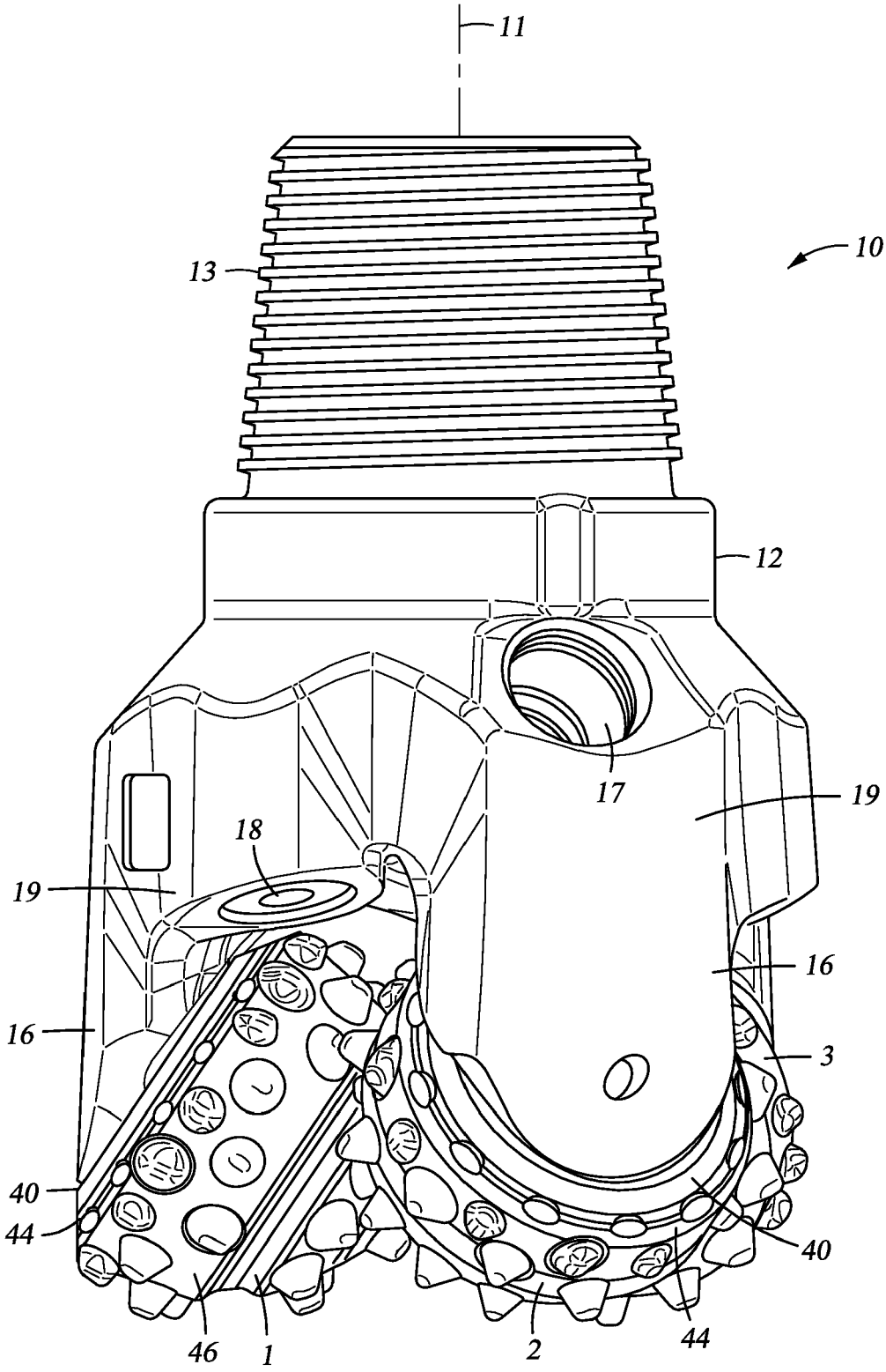
FIG. 1 is a perspective view of an earth-boring bit.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 11 and a bit body 12 having a threaded section 13 at its upper end that is adapted for securing the bit 10 to a drill string (not shown). Bit 10 has a predetermined gage diameter, defined by the outermost reaches of three rolling cone cutters 1, 2, 3 (cones 1 and 2 shown in FIG. 1) which are rotatably mounted on bearing shafts that depend from the bit body 12. Bit body 12 is composed of three sections or legs 19 (two legs shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter. Although the embodiment illustrated in FIG. 1 shows bit 10 as including three cone cutters 1-3, in other embodiments, bit 10 may include any number of cone cutters, such as one, two, three, or more cone cutters.

Figure 2:
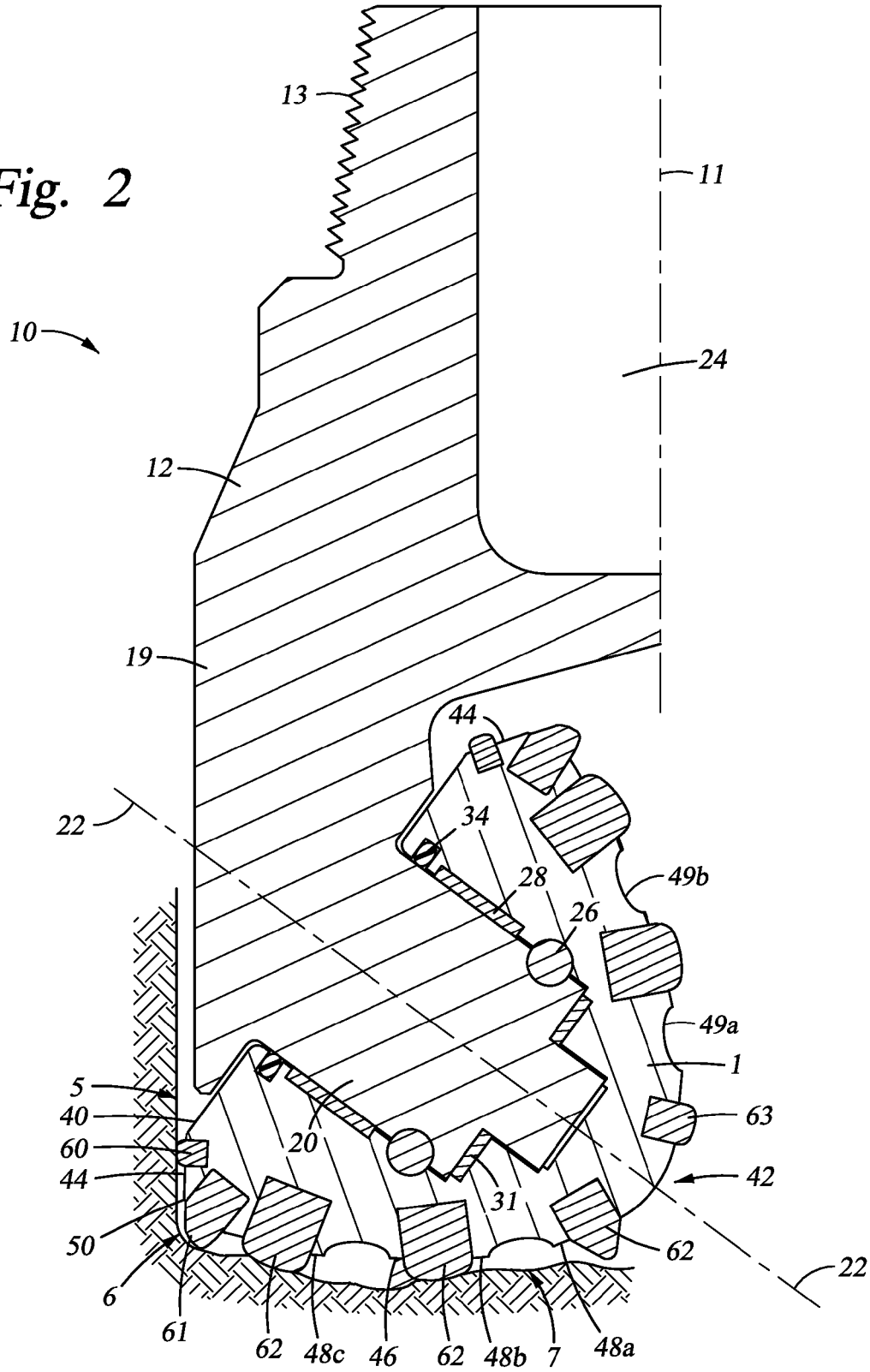
FIG. 2 is a partial section view through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial thrusts and axial thrusts are absorbed by journal sleeve 28 and thrust washer 31. The bearing structure shown is generally referred to as a journal bearing or friction bearing.

However, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cutter 1-3 includes a generally planar backface 40 and nose 42 generally opposite backface 40. Adjacent to backface 40, cutters 1-3 further include a generally frustoconical surface 44 that is adapted to retain cutting elements that scrape or ream the sidewalls of the borehole as the cone cutters 1-3 rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter.

Extending between heel surface 44 and nose 42 is a generally conical cone surface 46 adapted for supporting cutting elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions 48*a-c*, generally referred to as "lands", which are employed to support and secure the cutting elements as described in more detail below. Grooves 49*a, b* are formed in cone surface 46 between adjacent lands 48*a-c*.

In bit 10 illustrated in FIGS. 1 and 2, each cone cutter 1-3 includes a plurality of wear resistant inserts or cutting elements 60, 61*a*, 61, 62, 63. These cutting elements each include a generally cylindrical base portion with a central axis, and a cutting portion that extends from the base portion and includes a cutting surface for cutting formation material. All or a portion of the base portion is secured by interference fit into a mating socket formed in the surface of the cone cutter. Thus, as used herein, the term "cutting surface" may be used to refer to the surface of the cutting element that extends beyond the surface of the cone cutter. The "extension height" of the insert or cutting element is the distance from the cone surface to the outermost point of the cutting surface of the cutting element as measured perpendicular to the cone surface.

Referring specifically to FIG. 2, cone 1 includes heel cutting elements 60 extending from heel surface 44. Heel cutting elements 60 are designed to ream the borehole sidewall 5. In this embodiment, heel cutting elements 60 are generally flat-topped elements, although alternative shapes and geometries may be employed. Moving axially with respect to cone axis 22-1 of cone 1, adjacent to shoulder 50, cone 1 includes gage cutting elements 61 designed to cut corner portion 6 of the borehole (i.e., a portion of sidewall 5 and a portion of borehole bottom 7). In this embodiment, gage cutting elements 61 include a cutting surface having a generally slanted crest, although alternative shapes and geometries may be employed. Although cutting elements 61 are referred to herein as gage or gage row cutting elements, others in the art may describe such cutting elements as heel cutters or heel row cutters. Axially between gage cutting elements 61 and nose 42, cone 1 includes a plurality of bottomhole cutting elements 62, also sometimes referred to as inner row cutting elements. Bottomhole cutting elements 62 are designed to cut the borehole bottom 7. Thus, as used herein, the phrases "inner row" and "bottomhole" may be used to describe inserts or cutter elements that engage the borehole bottom (e.g., borehole bottom 7), and do not engage the borehole sidewall (e.g., borehole sidewall 5) or corner (e.g., borehole corner 6). In other words, heel cutting elements 60 and gage cutting elements 61 are not inner row or bottomhole cutting elements. In this embodiment, bottomhole cutting elements 62 include cutting surfaces having a generally rounded chisel shape, although other shapes and geometries may be employed. Cone 1 further includes a plurality of ridge cutting elements 63 on nose 42 designed to cut portions of the borehole bottom 7 that are otherwise left uncut by the other bottomhole cutting elements 62. Although only cone cutter 1 is shown in FIG. 2, cones 2 and 3 are similarly, although not identically, configured.

In general, the cutting surface of an insert or cutting element may be symmetric or asymmetric. As used herein, the term "symmetric" refers to an insert or the cutting surface of an insert that is symmetric across all planes parallel to and passing through the central axis of the insert's base portion. Thus, if every plane parallel to and passing through the central axis of an insert's base portion divides the insert into mirror image halves, the insert is symmetric. Conventional conical and semi-round top (SRT) inserts are examples of symmetric inserts. Further, the phrase "asymmetric" refers to an insert or cutting surface of an insert that is asymmetric across at least one plane parallel to and passing through the central axis of the insert's base portion. Thus, if any one plane parallel to and passing through the central axis of the insert's base portion divides the insert into two halves that are not mirror images, then the insert is asymmetric. Conventional chisel-shaped inserts as well as cutting elements 100, 200 shown in FIGS. 3-5 and 6-8, respectively, are examples of asymmetric inserts.

Figure 3:
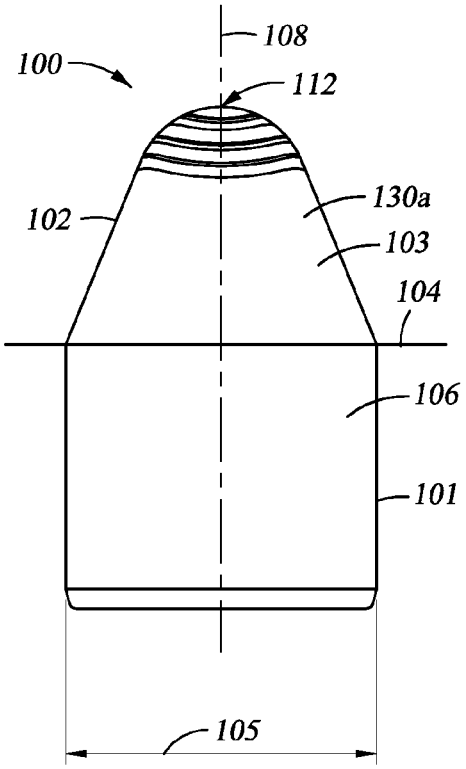
FIG. 3 is a front view of an embodiment of an asymmetrical cutting element having particular application in a rolling cone bit such as that shown in FIGS. 1 and 2.
Figure 5:
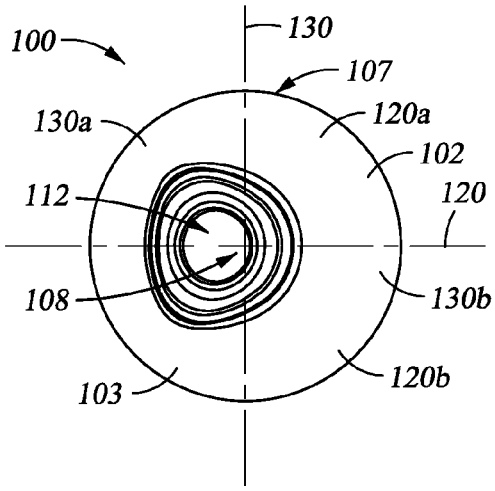
FIG. 5 is a top view of the cutting element of FIG. 3.
Figure 4:
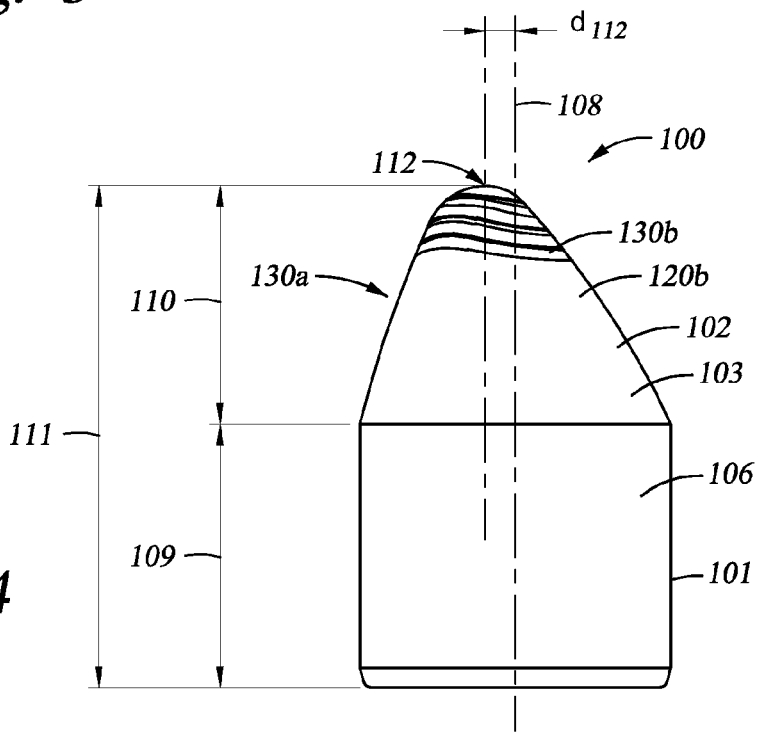
FIG. 4 is a side elevation view of the cutting element of FIG. 3.

Turning now to FIGS. 3-5, an asymmetric cutting element or insert 100 is shown and is believed to have particular utility when employed as an inner row cutting element, such as bottomhole cutting element 62 shown in FIGS. 1 and 2. However, cutting element 100 may also be employed as a gage or heel cutting element, such as gage cutting element 61 or heel cutting element 60, also shown in FIGS. 1 and 2. Cutting element or insert 100 includes a base portion 101 and a cutting portion 102 extending therefrom. Cutting portion 102 includes a cutting surface 103 extending from a plane of intersection 104 that generally divides base portion 101 and cutting portion 102. In this embodiment, base portion 101 is generally cylindrical, having a diameter 105, a central axis 108 and an outer surface 106 defining an outer circular profile or footprint 107 of insert 100. Base portion 101 has a height 109, and cutting portion 102 extends from base portion 101 so as to define an extension height 110. Collectively, base 101 and cutting portion 102 define the overall height 111 of insert 100.

Although base portion 101 is cylindrical in this embodiment, in general, base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of cutting element 100 generally represents the distance from the cone surface to the outermost point or apex 112 of cutting surface 103 as measured parallel to central axis 108 and perpendicular to the cone surface. In this embodiment, apex 112 is offset from central axis 108 by an offset distance $d_{112}$ measured perpendicularly from central axis 108.

As best shown in the top view of FIG. 5, a first reference plane 120 parallel to and passing through central axis 108 divides cutting surface 103 into two halves or sides 120*a, b* that are mirror images of each other; sides 120*a, b* of cutting surface 103 have similar geometries. However, a second reference plane 130 parallel to and passing through central axis 108 divides cutting surface 103 into two halves or sides 130*a, b* that are not mirror images of each other; sides 130*a, b* of cutting surface 103 have different geometries. Consequently, cutting element 100 and cutting surface 103 may be described as being asymmetric. By varying the orientation of cutting element 100 in the cone cutter, the geometry of the portion of cutting surface 103 that impacts the formation may be varied. For example, cutting element 100 may be oriented in the cone cutter such that side 103*a* with its particular geometry leads cutting element 100 in the formation during drilling, or such that side 103*b* with its different geometry leads cutting element 100 into the formation during drilling. It should be appreciated that a reference plane passing through the central axis of an insert divides the insert into two halves or sides that are opposite to each other or angularly spaced 180° apart about the insert axis. For example, sides 120*a, b* are angularly spaced 180° apart about the insert axis 108.

Figure 6:
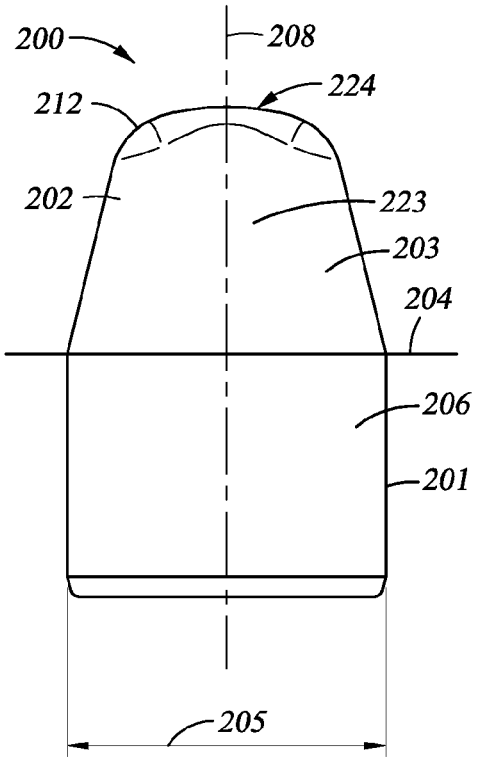
FIG. 6 is a front view of an embodiment of an asymmetrical cutting element having particular application in a rolling cone bit such as that shown in FIGS. 1 and 2.
Figure 8:
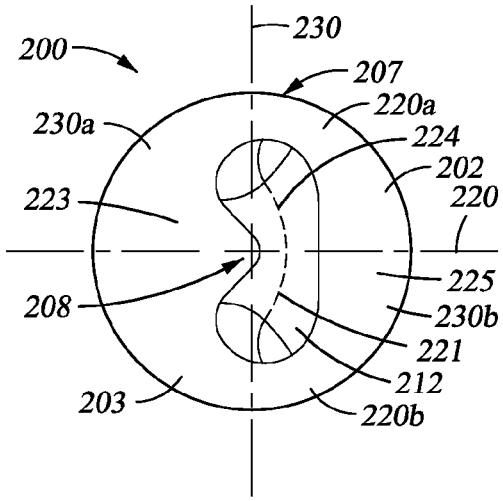
FIG. 8 is a top view of the cutting element of FIG. 6.
Figure 7:
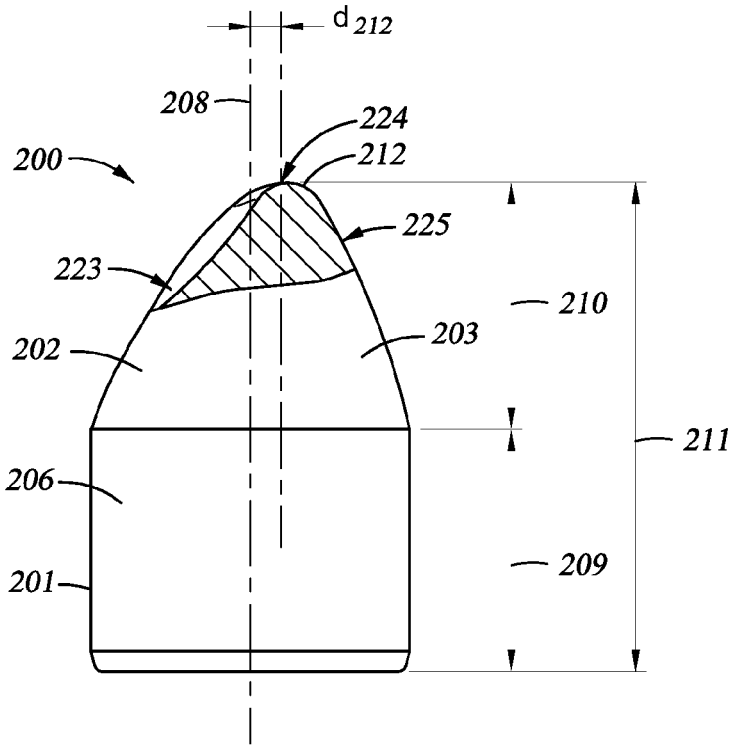
FIG. 7 is a partial cross-sectional side elevation view of the cutting element of FIG. 6.

Referring now to FIGS. 6-8, another asymmetric cutting element or insert 200 is shown and is also believed to have utility when employed as an inner row cutting element 62, heel cutting element 60 or gage cutting element 61, as shown in FIGS. 1 and 2. Cutting element or insert 200 includes a base portion 201 and a cutting portion 202 extending therefrom. Cutting portion 202 includes a cutting surface 203 extending from the reference plane of intersection 204 that divides base 201 and cutting portion 202. In this embodiment, base portion 201 is generally cylindrical, having a diameter 205, a central axis 208, and an outer cylindrical surface 206 defining an outer circular profile or footprint 207 of the insert (FIG. 5).

As best shown in FIG. 7, base portion 201 has a height 209, and cutting portion 202 extends from base portion 201 so as to have an extension height 210. Collectively, base 201 and cutting portion 202 define the insert's overall height 211. Base portion 201 may be formed in a variety of shapes other than cylindrical. As conventional in the art, base portion 201 is preferably retained within a rolling cone cutter by interference fit, or by other means, such as brazing or welding, such that cutting portion 202 and cutting surface 203 extend beyond the cone steel. Once mounted, the extension height 210 of the cutting element 200 is generally the distance from the cone surface to the outermost point or portion of cutting surface 203 as measured perpendicular to the cone surface and generally parallel to the insert's axis 208.

Referring still to FIGS. 6-8, cutting portion 202 includes a pair of flanking surfaces 223, 225 that taper or incline towards one another and intersect to form an elongate chisel crest 212 having a peaked ridge 224. Peaked ridge 224 extends along a crest median line 221 (FIG. 8). Flanking surface 223 is generally concave and flanking surface 225 is generally convex. As a result, crest median line 221 and peaked ridge 124 are generally arcuate or curved (i.e., non-linear) in top view (FIG. 8). In this embodiment, peaked ridge 224 and crest median line 221 are offset from central axis 208 by an offset distance $d_{212}$ measured perpendicularly from central axis 208 (FIG. 7).

As best shown in FIG. 8, a first reference plane 220 parallel to and passing through central axis 208 divides cutting surface 203 into two halves or sides 220*a, b* that are mirror images of each other; sides 220*a, b* of cutting surface 203 have similar geometries. However, a second reference plane 230 parallel to and passing through central axis 208 divides cutting surface 203 into two halves or sides 230*a, b* that are not mirror images of each other; sides 230*a, b* of cutting surface 203 have different geometries. Consequently, cutting element 200 and cutting surface 203 may be described as being asymmetric. Consequently, the geometry of the portion of cutting surface 203 that impacts the formation may be varied by adjusting the orientation of cutting element 200 in the cone cutter.

Cutting elements 100 and 200 are two examples of asymmetric cutting elements. As previously described, apex 112 and peaked ridge 224 are offset from central axis 108 and 208, respectively. However, it should be appreciated that other cutting elements may also be considered to be asymmetric, even though their apex or crest is aligned with or intersects their central axes. For example, one half or side of the cutting element may have a different geometry than the opposite side or half of the cutting element.

As previously described, in most conventional rolling cone bits employing asymmetric inserts (e.g., cutting elements 100, 200), each asymmetric insert on a given cone cutter (e.g., cone cutter 1, 2, 3) is mounted in substantially the same orientation relative to the direction of rotation of the cone cutter about the cone axis (e.g., cone axis 22). In particular, each asymmetric insert, whether disposed in a radially inner or outer row (relative to the bit axis), is typically mounted identically relative to the direction of rotation of the cone cutter. In other words, the same region of the cutting surface of each asymmetric insert is disposed in the same orientation relative to the direction of rotation of the cone cutter about the cone axis. Consequently, the leading side of the cutting surface of each asymmetric insert relative to the direction of cone rotation has the same geometry. Such conventional orientation does not account for the variation of insert movement on a given cone cutter resulting from the combined effects of cone rotation about the cone axis and bit rotation about the bit axis. Specifically, when the rotation of the bit about the bit axis is taken into account along with the rotation of the cone about the cone axis, the radially inner inserts (relative to the bit axis) move and impact the formation in a first direction, however, the radially outer inserts (relative to the bit axis) move and impact the formation in a second direction that is generally opposite the first direction. For example, referring briefly to FIG. 2 and taking into account the combined rotation of bit 10 about bit axis 11 and the rotation of cone 1 about cone axis 22, outer gage heel inserts 60 and first inner row inserts 62 immediately adjacent to gage inserts 60 tend to move in a first direction relative to borehole bottom 7, while the radially inner (relative to bit axis 11) inserts 62 of cone 1 move in a second direction relative to the borehole bottom 7. By considering the combined effects of the rotation of bit 10 and rotation of cone 1, radially outer first inner row inserts 62 may be oriented opposite to radially inner inserts 62 to offer the potential for improved insert and bit durability and ROP.

The ability to modify and optimize the orientation of the cutting elements or inserts to simultaneously account for the rotation of the bit about the bit axis and the rotation of the cone cutter about its cone axis hinges on the ability to determine which inserts (e.g., inserts 62) move together in the one direction, and which inserts move together in the opposite direction. One method for identifying which inserts move in one direction and which inserts move in the opposite direction will now be described with reference to FIG. 9.

Figure 9:
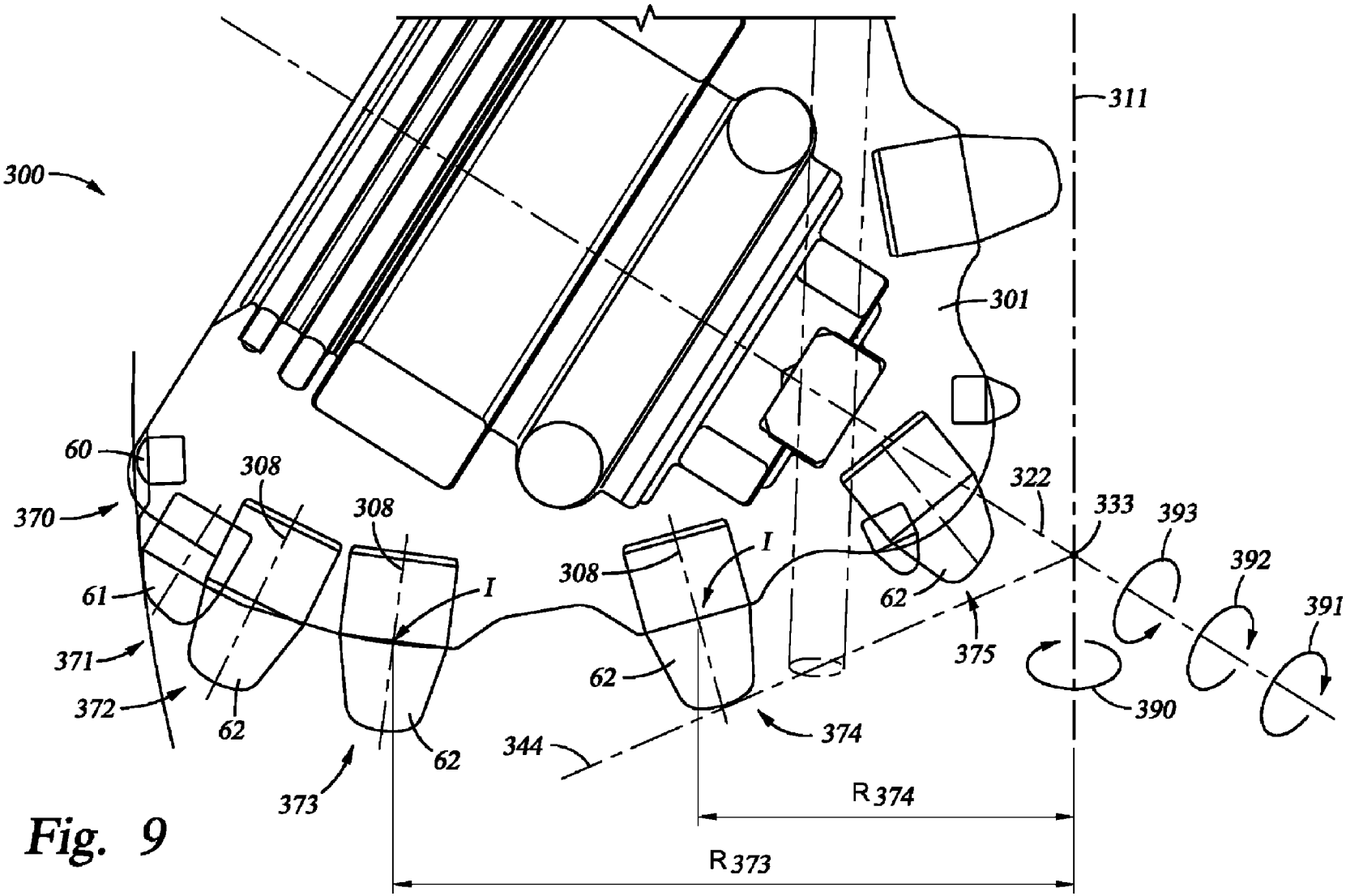
FIG. 9 is a schematic view showing, in rotated profile, the cutting profiles of all of the cutting elements of one rolling cone cutter of an earth-boring bit.

Referring to FIG. 9, a schematic view of the rotated profile of an embodiment of a drill bit 300 is shown. Drill bit 300 has a central bit axis 311 about which bit 300 rotates in the direction of arrow 390 (counterclockwise when bit 300 is viewed from the borehole bottom). A rolling cone cutter 301 is mounted to bit 300 and a cone axis 322 about which cone cutter 301 rotates in the cutting direction represented by arrow 391 (clockwise in top view along cone axis 322). Although only one cone cutter 301 is shown in FIG. 9, bit 300 may include additional rolling cone cutters configured similarly to cone 301.

A plurality of cutting elements or inserts 60, 61, 62 as previously described are mounted to cone cutter 301. The cutting profiles of inserts 60, 61, 62 are schematically shown in rotated profile view. It should be appreciated that all the inserts in a given circumferential row of a rolling cone cutter (e.g., inserts 60 on cone cutter 301) sweep through the same path, and thus, are superimposed on top of each other in rotated profile view. Moving axially along cone axis 322 and radially towards bit axis 311, cone 301 comprises a circumferential heel row 370 of heel cutting elements 60, a circumferential gage row 371 of gage cutting elements 61, a first circumferential inner row 372 of bottomhole cutting elements 62 immediately adjacent to gage row 371, a second circumferential inner row 373 of bottomhole cutting elements 62, and a third and fourth circumferential inner rows 374, 375 of bottomhole cutting elements 62.

As best shown in FIG. 9, the radial position of a particular cutting element or insert on a cone cutter is measured perpendicularly from the bit axis (e.g., bit axis 311) to the central axis of the insert at the surface of the cone cutter when the particular cutting element is furthest from the bit axis (i.e., at its bottom-most or bottom-hole engaging position) when viewed in rotated profile. Thus, cutting elements or inserts disposed in the same circumferential row are disposed at the same radial position relative to the bit axis. However, cutting elements or inserts in different circumferential rows that are axially spaced apart relative to the cone axis are disposed at different radial positions relative to the bit axis. For example, at its bottom-most position, each insert 62 has a central axis 308 that intersects the surface of cone cutter 301 at an intersection I in rotated profile view. Each insert 62 in second inner row 372 is disposed at a radial distance $R_{373}$ measured perpendicularly from bit axis 311 to intersection I of inserts 62 in second inner row 373. However, each insert 62 in third inner row 374 is disposed at a radial distance $R_{374}$ measured perpendicularly from bit axis 311 to intersection I of inserts 62 in third inner row 374. Radial distance $R_{373}$ is greater than radial distance $R_{374}$, and thus, inserts 62 in rows 373, 374 are disposed at different radial position relative to bit axis 311.

To identify the direction of motion and impact of inserts rows 60, 61, 62 taking into account the rotation of bit 300 about bit axis 311 in the direction of arrow 390 coupled with the rotation of cone 301 about cone axis 322, the intersection 333 of the cone axis 322 and the bit axis 311 in rotated profile view is identified. A line 344 extending from intersection 333 is then rotated toward the cutting profiles of inserts 60, 61, 62 until line 344 touches or contacts the outer surface and cutting profile of an insert 60, 61, 62, but does not cross the cutting profile of any other insert 60, 61, 62. Thus, as used herein, the phrase "transition line" may be used to describe the line (e.g., line 344) extending from the intersection (e.g., intersection 333) of the bit axis (e.g., bit axis 311) and the cone axis (e.g., cone axis 322) in rotated profile view. In addition, the phrases "transition insert" and "transition cutting element" are used to describe a cutting element or insert having a cutting surface or cutting profile that is contacted by the transition line without the transition line crossing through the cutting profile of any other insert in rotated profile view.

In this embodiment, the transition insert(s) are inserts 62 of third inner row 374. If transition line 344 is positioned to contact the cutting surface or cutting profile of any other insert(s) (e.g., inserts 62 of first, second, or fourth inner rows 372, 373, 375), transition line 344 would cross the cutting profile of one or more other inserts. Taking into account the combined effects of bit rotation about the bit axis and cone rotation about the cone axis, the transition insert(s), all inserts positioned at the same radial position as the transition insert (s) (i.e., inserts in the same circumferential row as the transition insert), and all inserts positioned radially inward of the transition insert(s) (relative to the bit axis) move together in a first direction about the cone axis; and all the inserts positioned radially outward of the transition insert(s) (relative to the bit axis) move in a second direction about the cone axis that is generally opposite to the first direction. Thus, all inserts positioned at the same radial position as the transition insert (s) and all inserts positioned radially inward of the transition insert(s) (relative to the bit axis) impact the formation in the first direction; and all the inserts positioned radially outward of the transition insert(s) (relative to the bit axis) impact the formation in the second direction that is generally opposite to the first direction. In this exemplary embodiment, inserts 62 of third inner row 374 and fourth inner row 375 move together and impact the formation in a first direction represented by arrow 392 (about cone axis 322) that is generally the same as cutting direction 391 of cone cutter 301. Thus, as shown in FIG. 9, inserts 62 in rows 374, 375 will rotate out of the paper at their bottom-most position. However, inserts 60 of heel row 370, inserts 61 of gage row 371, and inserts 62 of first and second inner rows 372, 373 move together and impact the formation in a second direction represented by arrow 393 (about cone axis 322) that is generally opposite to the first direction 392 and cutting direction 391. Thus, cone cutter 301 rotates about cone axis 322 in cutting direction 391, transition inserts 62 in row 374 and inserts 62 in row 375 (i.e., inserts radially inward of the transition inserts) move in the same direction as cone cutter 301 (i.e., first direction 392 and cutting direction 391), however, inserts 60 of heel row 370, inserts 61 of gage row 371, and inserts 62 of first and second inner rows 372, 373 move in second direction 393 that is opposite to first direction 392 and cutting direction 391 of cone cutter 301. Taking into account these differences in insert movement, the placement and orientation of inserts 60, 61, 62 on cone 301 may be adjusted to offer the potential for improved durability and ROP.

Figure 10:
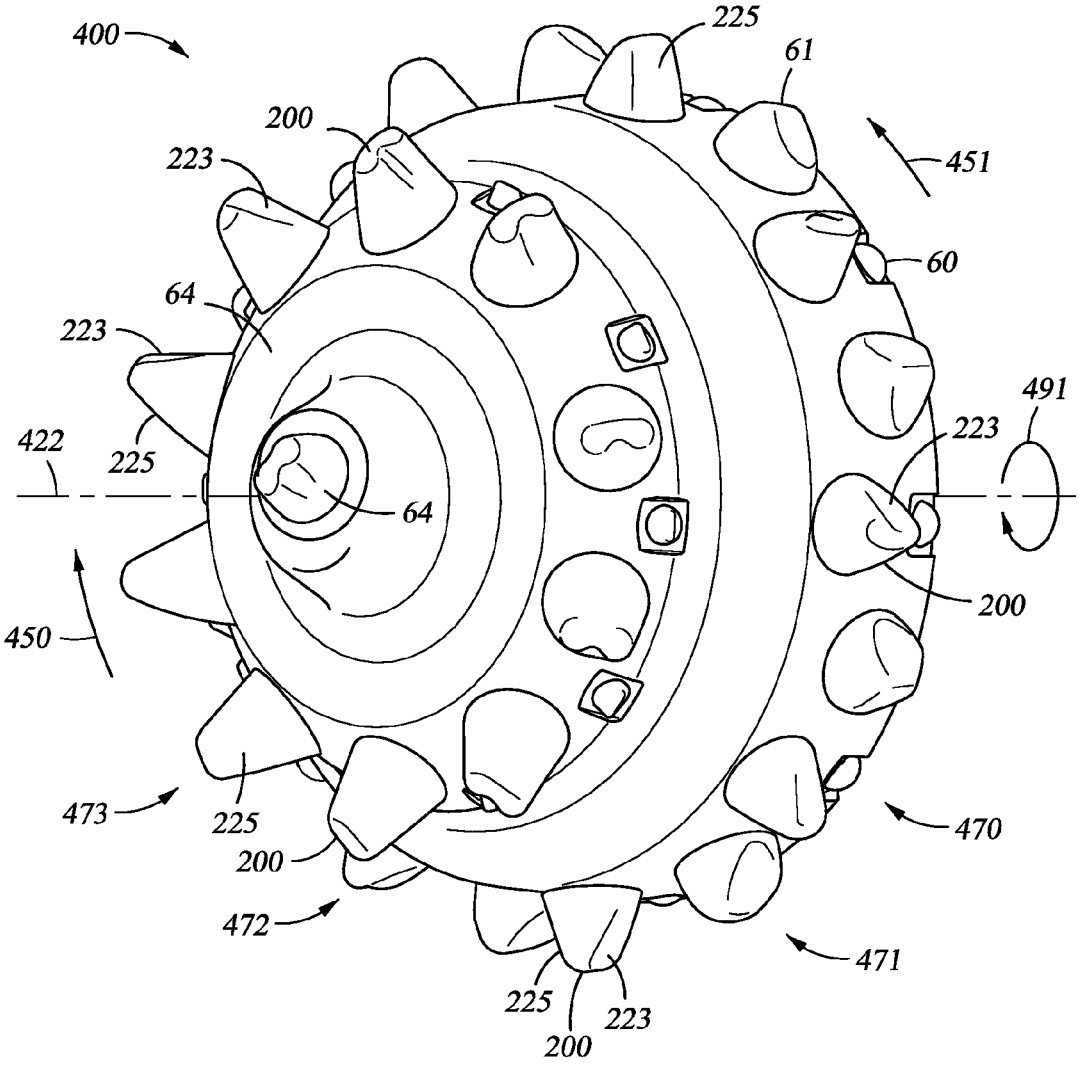
FIG. 10 is a perspective view of an embodiment of a rolling cone cutter including a plurality of the cutting elements of FIG. 6.
Figure 11:
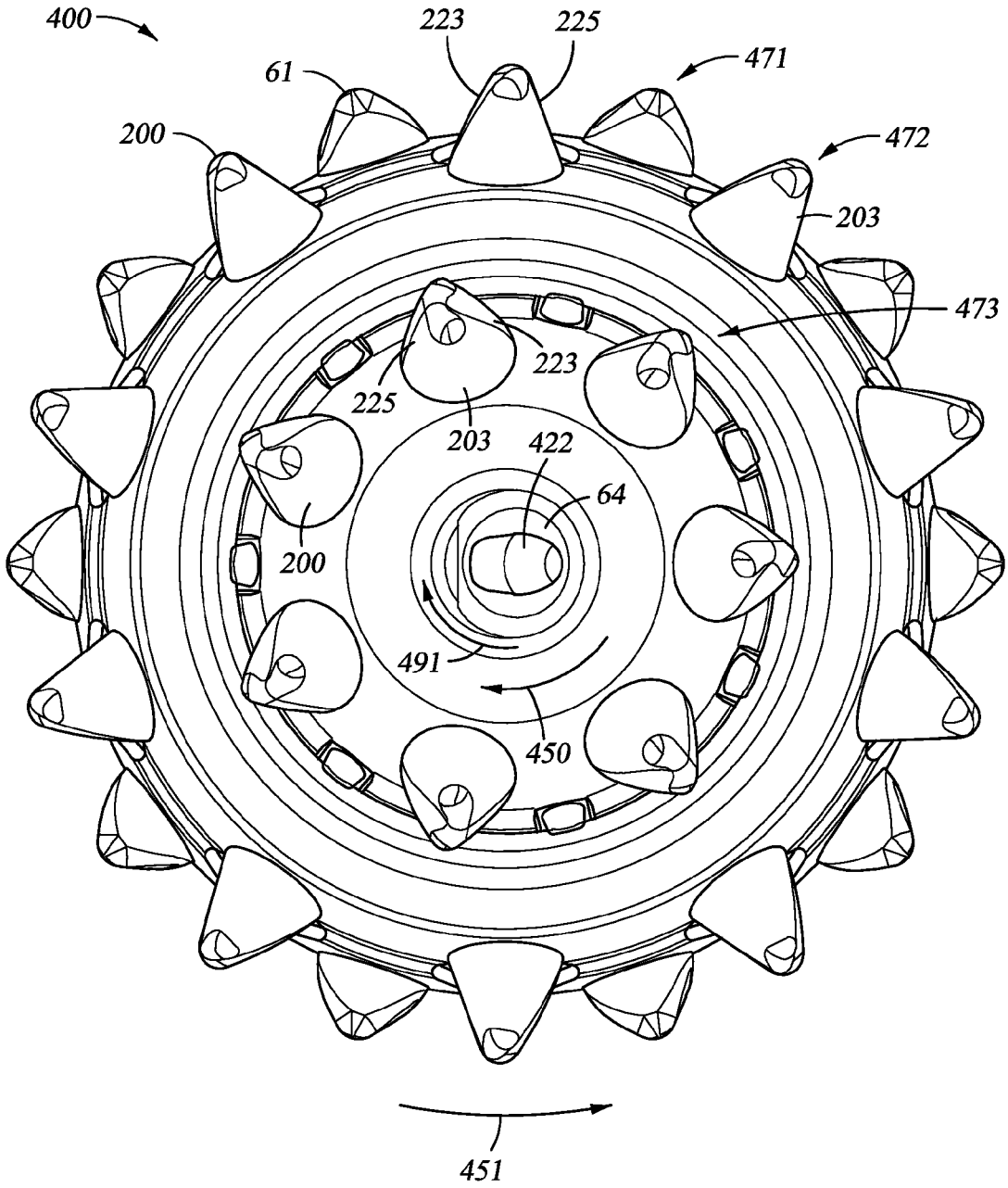
FIG. 11 is a top view of the cone cutter of FIG. 10.

Referring now to FIGS. 10 and 11, an embodiment of a cone cutter 400 constructed in accordance with the principles described herein is shown. Cone cutter 400 may be mounted to a rolling cone bit such as bit 300 previously described. In this embodiment, cone cutter 400 has a central cone axis 422 about which cone cutter 400 rotates in a cutting direction represented by arrow 491 (clockwise in top view along axis 422) and includes a heel row 470 of heel cutting elements 60, a gage row 471 of gage cutting elements 61, a first inner row 472 and a second inner row 473 of asymmetric bottom hole cutter elements 200 previously described, and a nose cutting element 64. Utilizing the method previously described with reference to FIG. 9, each cutting element 200 in second inner row 473 represents a "transition insert." Thus, taking into consideration the rotation of the bit (to which cone cutter 400 is mounted) about its bit axis (typically counterclockwise when viewed from the borehole bottom), and the rotation of cone cutter 400 about its cone axis 422 in cutting direction 491, cutting elements 200 in second inner row 473 and nose cutting element 64 (i.e., cutting elements at the same radial position as the transition insert(s) and cutting elements radially inward of the transition insert(s) relative to the bit axis) move generally together and impact the formation in a first direction 450 about the cone axis 422 that is aligned with cutting direction 491 of cone cutter 401, where as cutting elements 200 in first inner row 472, gage cutting elements 61, and heel cutting elements 60 (i.e., cutting elements radially outward of the transition insert(s) relative to the bit axis) move generally together and impact the formation in a second direction 451 about cone axis 422 that is opposite to first direction 450 and cutting direction 491.

Depending on a variety of factors including, without limitation, the application, the type of formation being drilled, or combinations thereof, it may be desirable to orient inserts 200 such that a particular portion of cutting surface 203 having a particular geometry leads insert 200 into the formation. In other words, it may be desirable to orient inserts 200 such that a particular portion of cutting surface 203 having a particular geometry is on the leading side of insert 200 relative to the direction in which it impacts the formation. For example, it may be desirable for the side of cutting surface 203 including concave flank 223 be positioned to impact and lead insert 200 into the formation. Accordingly, taking into account the rotation of the bit to which cone 400 is mounted and the rotation of cone 400, each cutting element 200 in second inner row 473 is oriented such that the side of cutting surface 203 including concave flank 223 leads into the formation relative to the first direction 450. In this orientation, concave flank 223 is on the leading side relative to first direction 450 and on the leading side relative to cutting direction 491 of cone cutter 401. However, as cutting elements 200 in first inner row 472 move in the opposite first direction 450 and cutting direction 491, cutting elements 200 in first inner row 472 are oriented oppositely cutting elements 200 in second inner row 473. Namely, each cutting element 200 in first inner row 472 is oriented such that the side of cutting surface 203 including concave flank 223 leads into the formation relative to second direction 451. In this orientation, concave flank 223 is on the leading side relative to second direction 451, but on the trailing side relative to cutting direction 491 of cone cutter 401. Thus, inserts 200 in inner rows 472, 473 are oriented in opposite directions to account for the different movements of inserts 200 in rows 472, 473—inserts 200 in second inner row 473 are oriented such that concave flank 223 is on the leading side relative to cutting direction 491, while inserts 200 in first inner row 472 are oriented such that concave flank 223 is on the trailing side relative to cutting direction 491.

Figure 12:
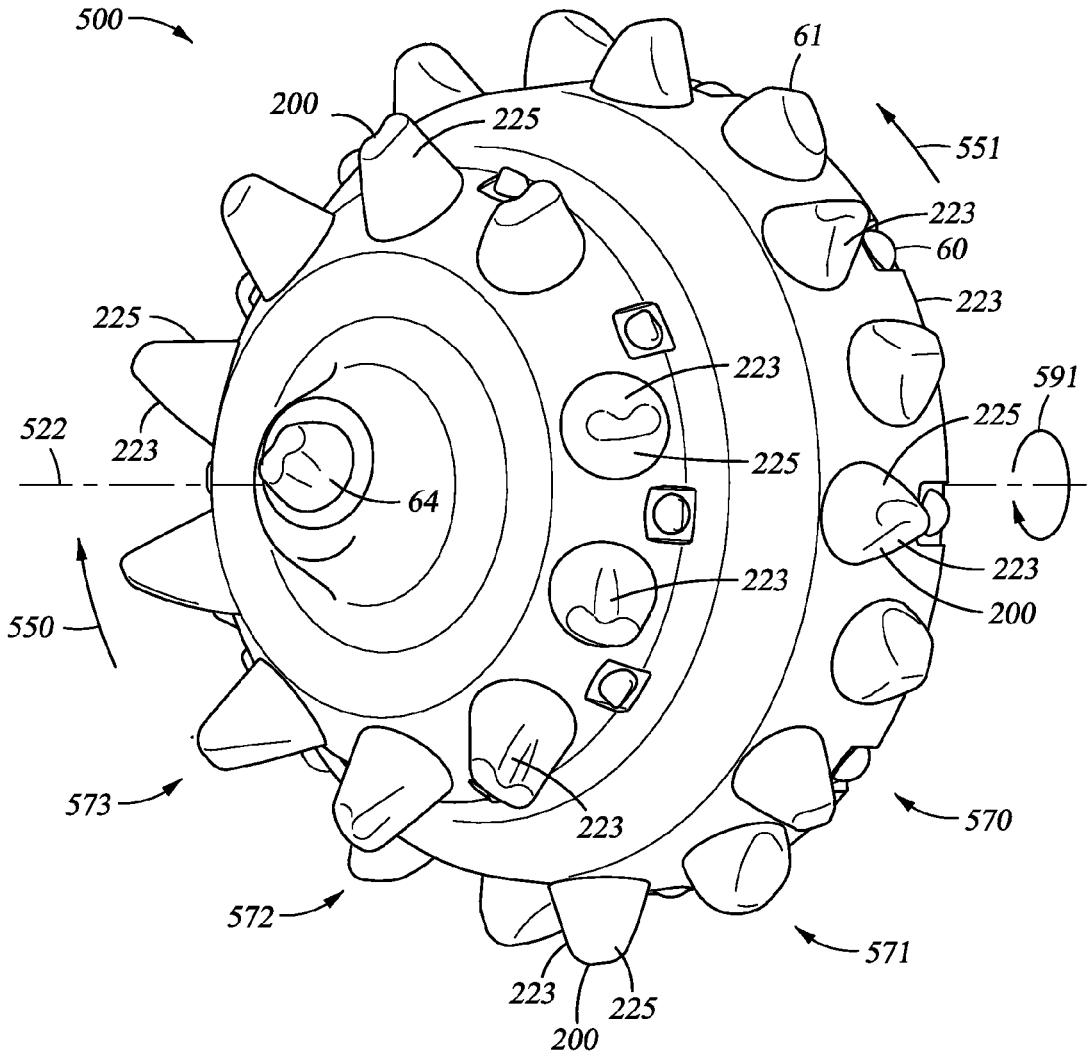
FIG. 12 is a perspective view of an embodiment of a rolling cone cutter including a plurality of the cutting elements of FIG. 6.
Figure 13:
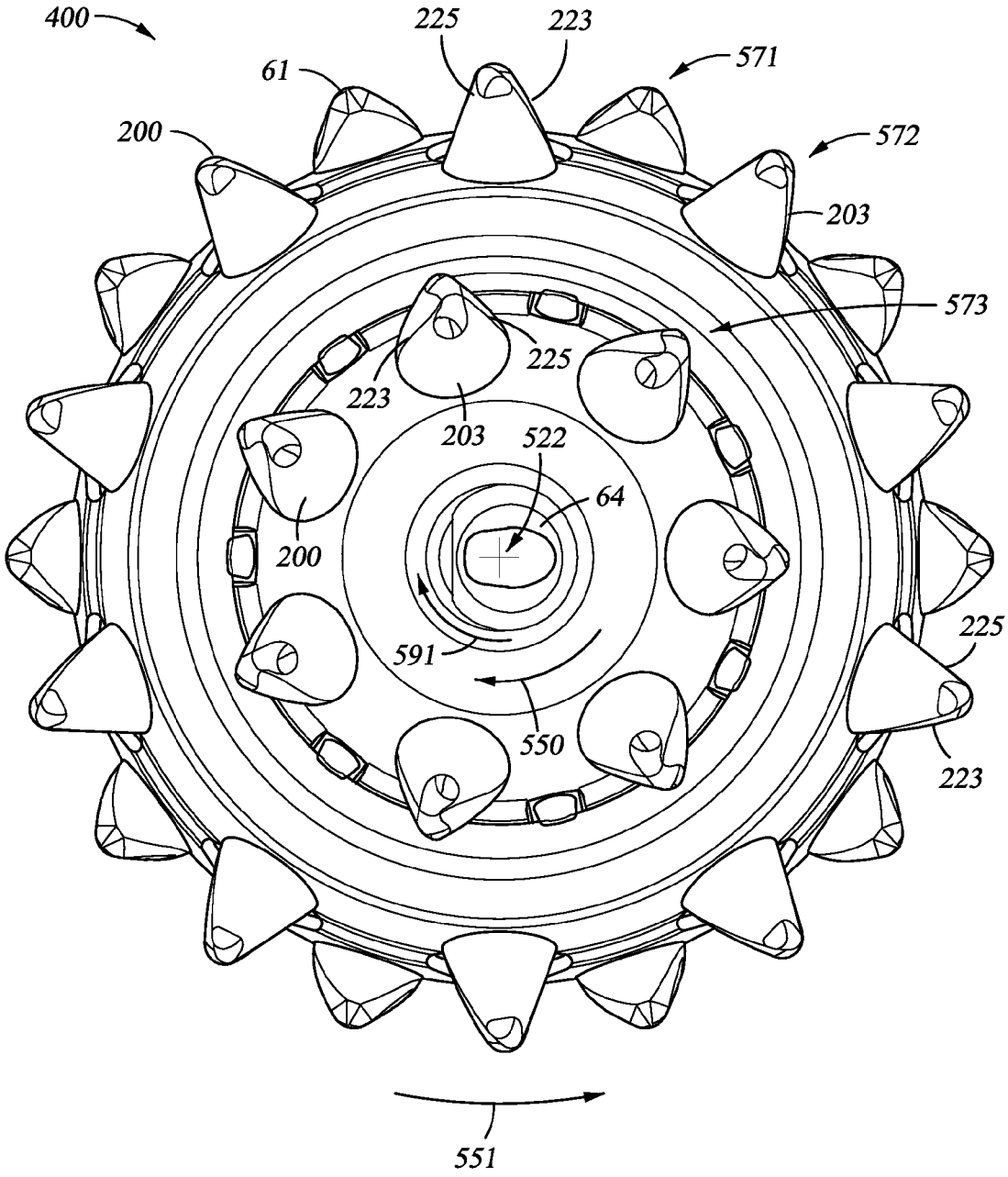
FIG. 13 is a top view of the cone cutter of FIG. 12.

Referring now to FIGS. 12 and 13, another embodiment of a cone cutter 500 constructed in accordance with the principles described herein is shown. Cone cutter 500 may be mounted to a rolling cone bit such as bit 300 previously described. Cone cutter 500 is similar to cone cutter 400 previously described. Namely, cone cutter 500 has a central cone axis 522 about which cone cutter 500 rotates in cutting direction 591, and includes a heel row 570 of heel cutting elements 60, a gage row 571 of gage cutting elements 61, a first inner row 572 and a second inner row 573 of asymmetric bottom hole cutter elements 200 previously described, and a nose cutting element 64. Taking into consideration the rotation of the bit (to which cone cutter 500 is mounted) about its bit axis (typically counterclockwise when viewed from the borehole bottom), and the rotation of cone cutter 500 about its cone axis 522 in cutting direction 591, cutting elements 200 in second inner row 573 and nose cutting element 64 move generally together and impact the formation in a first direction 550 about cone axis 522 that is aligned with cutting direction 591, where as cutting elements 200 in first inner row 572, gage cutting elements 61, and heel cutting elements 60 move generally together and impact the formation in a second direction 551 about cone axis 522 that is opposite to first direction 550 and cutting direction 591.

Depending on a variety of factors including, without limitation, the application, the type of formation being drilled, or combinations thereof, it may be desirable to orient insets 200 such that convex flank 225 of cutting surface 203 is on the leading side of insert 200 relative to the direction in which insert 200 impacts the formation. To achieve this result taking into account the rotation of the bit to which cone 500 is mounted and the rotation of cone 500, each cutting element 200 in second inner row 573 is oriented such that convex flank 225 is on the leading side relative to first direction 550 (i.e., such that convex flank 225 of each cutting element 200 in second inner row 573 impacts the formation). In this orientation, convex flank 225 is on the leading side relative to first direction 550 and on the leading side relative to cutting direction 591 of cone cutter 501. Inserts 200 of first inner row 572 are oriented oppositely such that convex flank 225 is on the leading side relative to second direction 551 (i.e., such convex flank 225 of inserts 200 of first inner row 572 impacts the formation). In this orientation, convex flank 225 is on the leading side relative to second direction 551, but on the trailing side relative to cutting direction 591 of cone cutter 501. Thus, inserts 200 in rows 572, 573 are oriented in opposite directions to account for the different movements of inserts 200 in rows 572, 573—inserts 200 in second inner row 573 are oriented such that convex flank 225 is on the leading side relative to cutting direction 591, while inserts 200 in first inner row 572 are oriented such that convex flank 225 is on the trailing side relative to cutting direction 591.

As previously described, cutting elements and inserts are typically secured by an interference fit in mating sockets provided in the surface of a rolling cone cutter (e.g., cone cutters 1, 2, 3). The concept of orienting asymmetric inserts in opposite directions in different regions of a cone cutter (e.g., radially outside the transition insert relative to the bit axis vs. radially inside the transition insert relative to the bit axis) to account for the combined effect of bit rotation and cone rotation may be extended to inserts (symmetric or asymmetric) secured in an offset or canted orientation.

Figure 14:
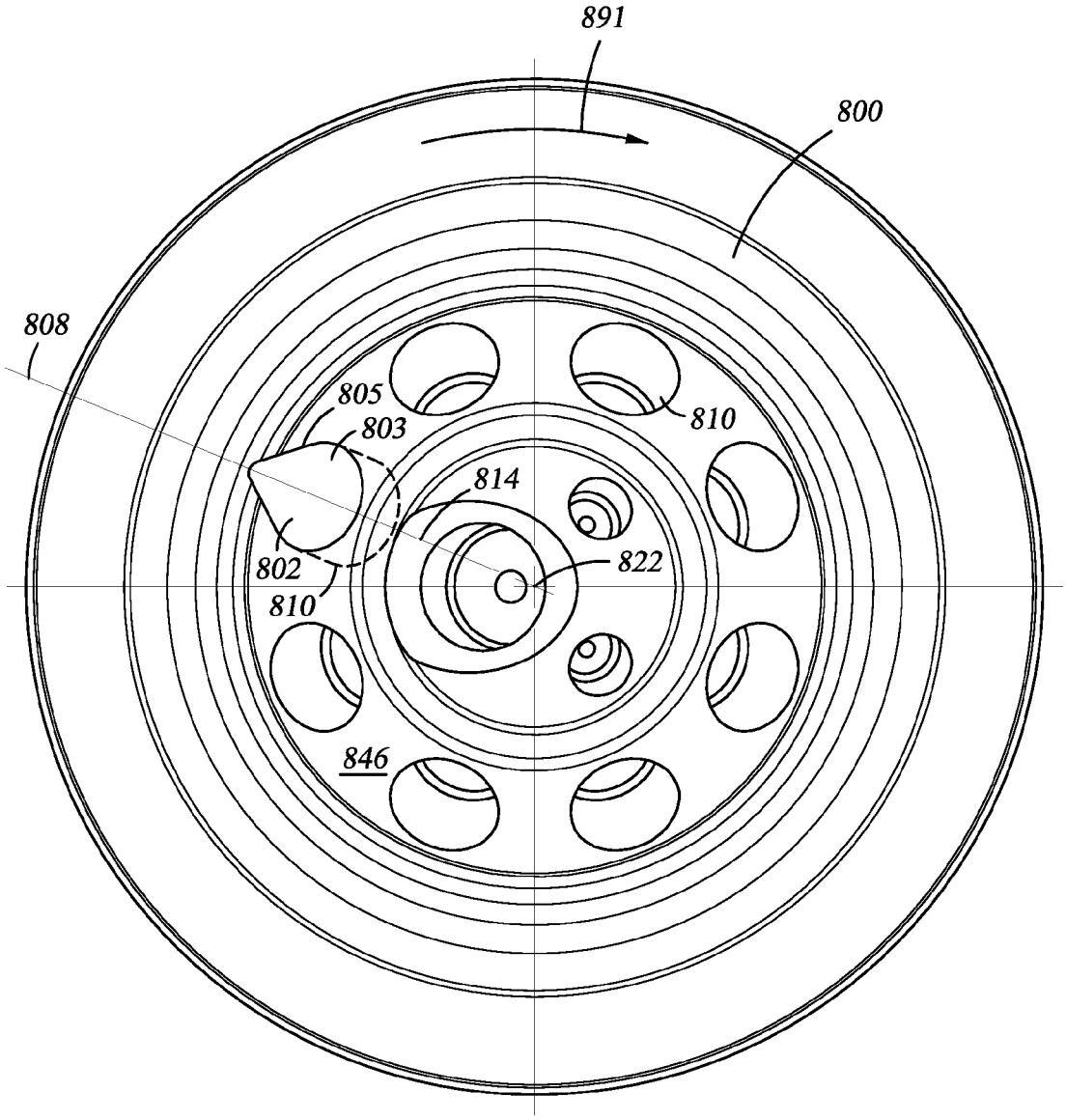
FIG. 14 is a schematic top view of a cone cutter configured for axis coplanar orientation of inserts.

Referring now to FIG. 14, an exemplary cone cutter 800 for mounting a plurality of inserts 805 is shown. Cone cutter 800 has a central axis 822 about which cone cutter 800 rotates in a cutting direction 891, and a cone surface 846 including a plurality of sockets 810. Sockets 810 may be drilled into cone surface 846 or formed by other suitable means.

Each insert 805 (only one insert 805 shown in FIG. 14) includes a grip or base portion 801 having a central axis 808 and a cutting portion 802 extending therefrom. Cutting portion 802 has a cutting surface 803 that engages the formation. Base portion 801 is secured in mating socket 810 by an interference fit or other suitable means. When mounted to cone cutter 800 cutting portion 802 and cutting surface 803 extend from cone surface 846. In this embodiment, each insert 805 is a symmetric insert. However, asymmetric inserts may also be employed with cone cutter 800.

In this exemplary cone cutter 800, sockets 810 are formed substantially perpendicular to cone surface 846 such that central axis 808 of each insert 805, which coincides with the central axis of socket 810, is substantially perpendicular to cone surface 846 when base portion 801 is secured in socket 810. A single plane 814, also referred to as insert axis plane 814, contains central axis 808 and is parallel to cone axis 822. As used herein, the phrase "insert axis plane" refers to a plane that contains the central axis of the insert and is parallel to the cone axis of the cone cutter to which the insert is mounted. In this embodiment, insert axis plane 814 also contains cone axis 822. Thus, insert axis plane 814 contains both central axis 808 of insert 805 and cone axis 822. Accordingly, insert central axis 808 and cone axis 822 may be described as coplanar. As used herein, the term "coplanar" may be used to describe an insert or socket having a central axis that lies in a common plane with the cone axis. Further, as used herein, the phrase "non-coplanar" may be used to describe an insert or socket having a central axis that does not lie in a common plane with the cone axis.

Regarding coplanar symmetric inserts, and taking into account the combined effects of bit rotation and cone rotation, the geometry of the portion of the cutting surface that impacts the formation will be the same regardless of the insert's position on the cone cutter relative to the transition insert (i.e., radially inside or radially outside the transition insert relative to the bit axis), and regardless how the symmetric insert is rotationally oriented within the socket. Thus, the geometry of the portion of the cutting surface of a coplanar symmetric insert that impacts the formation not depend on (a) the location of the symmetric insert on the cone cutter relative to the transition insert (i.e., radially inside or radially outside the transition insert relative to the bit axis), or (b) how the symmetric insert is rotationally oriented within the socket. However, as will be described in more detail below, the geometry of the portion of the cutting surface of a non-coplanar symmetric insert that impacts the formation depends on (a) the location of the symmetric insert on the cone cutter relative to the transition insert (i.e., radially inside or radially outside the transition insert relative to the bit axis), but does not depend on (b) on the rotational orientation of the symmetric insert in the socket. Therefore, according to embodiments described herein, non-coplanar symmetric inserts are preferably oriented to account for differences in motion based on their position relative to the transition insert (i.e., radially at or inside the transition insert relative to the bit axis, or radially outside the transition insert relative to the bit axis).

Regarding coplanar asymmetric inserts, and taking into account the combined effects of bit rotation and cone rotation, the geometry of the portion of the cutting surface that impacts the formation depends on (a) the location of the asymmetric insert relative to the transition insert (i.e., radially inside or radially outside the transition insert relative to the bit axis), and (b) how the asymmetric insert is rotationally oriented within the socket. The same is true for non-coplanar asymmetric inserts. Namely, the geometry that the portion of the cutting surface that impacts the formation depends on (a) the location of the asymmetric insert relative to the transition insert (i.e., radially inside or radially outside the transition insert relative to the bit axis), and (b) how the asymmetric insert is rotationally oriented within the socket. Therefore, according to embodiments described herein, coplanar asymmetric inserts and non-coplanar asymmetric inserts are preferably oriented to account for differences in motion based on their position relative to the transition insert. In particular, inserts positioned at the same radial position as the transition insert or radially inward of the transition insert relative to the bit axis are oriented such that the side or half of the cutting surface that is desired to impact the formation is on the leading side relative to the cutting direction of the cone cutter, while inserts radially outward of the transition insert relative to the bit axis are preferably oriented such that the side or half of the cutting surface that is desired to impact the formation is on the trailing side relative to the cutting direction of the cone cutter.

Figure 15:
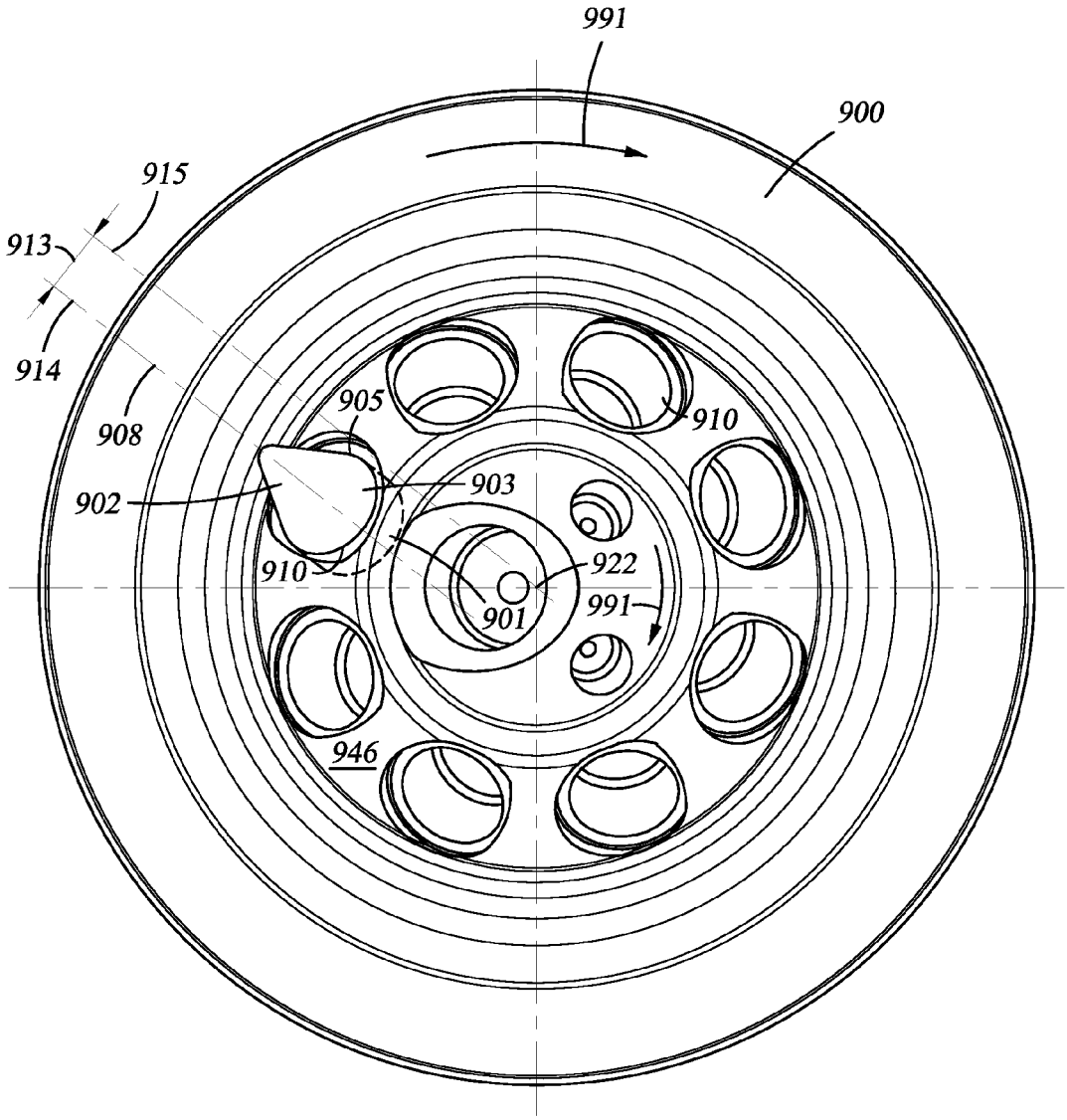
FIG. 15 is a schematic top view of a cone cutter configured for axis non-coplanar orientation of inserts.

Referring now to FIG. 15, another exemplary cone cutter 900 for mounting a plurality of inserts 905 is shown. Cone cutter 900 has a central axis 922 about which cone cutter 900 rotates in a cutting direction 991, and a cone surface 946 including a plurality of sockets 910.

Each insert 905 (only one insert 905 shown in FIG. 15) includes a grip or base portion 901 having a central axis 908, and a cutting portion 902 extending therefrom. Cutting portion 902 has a cutting surface 903 that engages the formation. Base portion 901 is secured in mating socket 910 by an interference fit or other suitable means. When mounted to cone cutter 900 cutting portion 902 and cutting surface 903 extend from cone surface 946.

In this exemplary cone cutter 900, sockets 910 are not formed perpendicular to cone surface 946, and thus, central axis 908 of each insert 905 is not perpendicular to cone surface 946 when base portion 901 is secured in socket 910. Further, an insert axis plane 914 that contains central axis 908 of insert 905 and is parallel to cone axis 922 does not contain cone axis 922. Thus, central axis 908 and cone axis 922 do not share a common plane, and hence, inserts 905 are non-coplanar. Insert axis plane 914 is offset from a plane 915, also referred to as cone axis plane 915, that contains cone axis 922 and is parallel to insert axis plane 914. Thus, as used herein, the phrase "cone axis plane" refers to a plane that contains the cone axis and is parallel to the insert axis plane of a particular insert mounted to the cone cutter. It should be appreciated that for co-planar inserts, the insert axis plane and the cone axis plane are coincident, however, for non-coplanar inserts, the insert axis plane and the cone axis plane are spaced apart. In particular, insert axis plane 914 is offset from cone axis plane 915 by an offset distance 913 measured perpendicularly from insert axis plane 914 to cone axis plane 915. Thus, as used herein, the phrase "offset distance" refers to the distance measured perpendicularly from an insert axis plane to a cone axis plane. For coplanar inserts, the offset distance is zero, however, for non-coplanar inserts, the offset distance may be positive or negative depending on which side of the cone axis plane the insert axis plane is disposed as is described in more detail below. The sign of the offset distance (i.e., positive or negative) is preferably based on the direction of insert movement taking into account the rotation of the bit and the cone so as to orient the insert 905 to improve durability and ROP.

In general, offset distance (e.g., offset distance 913) may be positive or negative depending on the orientation of the insert axis plane relative to the cone axis plane in the region between the insert and the cone axis in top view. For purposes of this disclosure, if the insert axis plane is disposed ahead of or leads the cone axis plane relative to the cutting direction of the cone cutter in the region between the insert and the cone axis, the offset distance is considered positive. On the other hand, if the insert axis plane is disposed behind or trails the cone axis plane relative to the cutting direction of the cone cutter in the region between the insert and the cone axis, the offset distance is considered negative. For example, as shown in FIG. 9, insert axis plane 914 is disposed behind or trails cone axis plane 915 relative to cutting direction 991 in the region between insert 905 and cone axis 922 in top view, and thus, offset distance 913 is considered negative. It should be appreciated that the described sign convention for the offset distance may be reversed.

Taking into account the combined effects of bit rotation and cone rotation, the side of axis non-coplanar symmetric inserts (e.g., insert 905) that impacts the formation will depend on its position on the cone cutter (e.g., radially inside or radially outside the transition insert relative to the bit axis), but not depend on the rotational orientation of the insert in a given socket. Further, taking into account the combined effects of bit rotation and cone rotation, the side of axis non-coplanar asymmetric inserts that impacts the formation will depend on its position relative to the transition insert (i.e., radially inside or radially outside the transition insert relative to the bit axis), and depend on the rotational orientation of the insert in a given socket. Therefore, according to embodiments described herein, axis non-coplanar symmetric inserts and axis non-coplanar asymmetric inserts are preferably positioned and oriented to account for differences in motion based on their position relative to the transition insert (i.e., radially at or inside the transition insert relative to the bit axis, or radially outside the transition insert relative to the bit axis).

Figure 16:
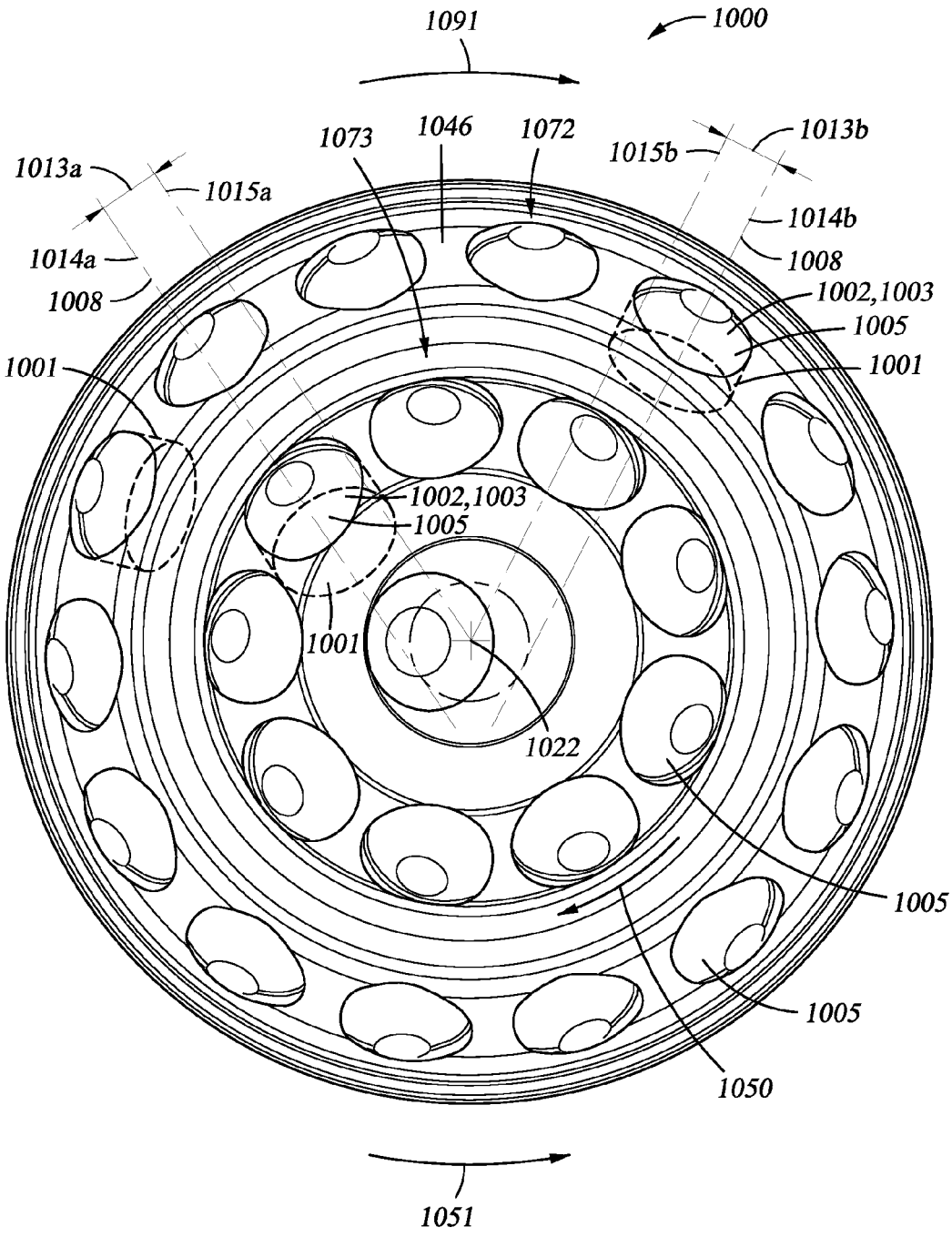
FIG. 16 is a perspective top view of an embodiment of a rolling cone cutter including non-coplanar symmetric inserts.

Referring now to FIG. 16, a cone cutter 1000 for mounting a plurality of inserts 1005 is shown. Cone cutter 1000 has a central axis 1022 about which cone cutter 1000 rotates in a cutting direction 1091, and a cone surface 1046 including a plurality of sockets 1010. Cone cutter 1000 may be mounted to any suitable rolling cone bit such as bit 300 previously described.

Each insert 1005 includes a grip or base portion 1001 having a central axis 1008, and a cutting portion 1002 extending therefrom. Cutting portion 1002 has a cutting surface 1003 that engages the formation. Base portion 1001 is secured in mating socket 1010 by an interference fit or other suitable means. When mounted to cone cutter 1000 cutting portion 1002 and cutting surface 1003 extend from cone surface 1046. In this embodiment, each insert 1005 is a symmetric insert. In particular, inserts 1005 are conical inserts. A first plurality of inserts 1005 are disposed in a first inner row 1072, a second plurality of inserts 1005 are disposed in a second inner row 1073, and one insert 1005 is disposed on the nose of cone 1000. When cone cutter 1000 is mounted to a bit, and the process previously described with reference to FIG. 9 is utilized to identify the transition insert(s), inserts 1005 in second inner row 1073 represent the transition inserts. Thus, taking into account rotation of cone 1000 in cutting direction 1091 and the rotation of the bit to which cone 1000 is mounted about the bit axis, inserts 1005 in second inner row 1073 and all inserts radially inward of inserts 1005 in second inner row 573 relative to the bit axis (e.g., nose insert 1005) move in a first direction 1050 that is the same as cutting direction 1091, however, inserts 1005 in first inner row 1072 and all inserts radially outward of inserts 1005 in first inner row 1072 move in a second direction 1051 that is opposite to cutting direction 1091 and first direction 1050.

Depending on a variety of factors including, without limitation, the application, the type of formation being drilled, or combinations thereof, it may be desirable to orient inserts 1005 at a non-perpendicular angle relative to cone surface 1046 (i.e., such that axes 1008 are not perpendicular to cone surface 1046). As a result such inserts will have a particular offset relative to cone axis plane. To achieve the same angular orientation and offset distance of inserts 1005 upon impact with the formation and taking into account the rotation of cone cutter 1000 in cutting direction 1091 and the rotation of the bit to which cone cutter 1000 is mounted about its bit axis, inserts 1005 in certain radial positions on cone 1000 may be oriented with positive offsets, while inserts 1005 in different radial positions on cone 1000 may be oriented with negative offsets.

For example, in this embodiment of cone cutter 1000, sockets 1010 of inner rows 572, 573 are not formed perpendicular to cone surface 1046, and thus, central axis 1008 of each insert 1005 in inner rows 1072, 1073 is not perpendicular to cone surface 1046. In particular, for each insert 1005 in second inner row 1073, an insert axis plane 1014*a* that contains central axis 1008 of and is parallel to cone axis 1022 does not contain cone axis 1022. Thus, central axis 1008 of each insert 1005 in second inner row 1073 is non-coplanar. Insert axis plane 1014*a* of each insert 1005 in second inner row 1073 is offset from a cone axis plane 1015*a*, that contains cone axis 1022 and is parallel to insert axis plane 1014*a*, by an offset distance 1013*a*. In this embodiment, offset distance 1013*a* is negative as each insert axis plane 1014*a* is behind or trails its corresponding cone axis plane 1015*a* relative to the cutting direction 1091 of cone cutter 1000 when the region between each insert 1005 in second inner row 1073 is viewed in top view. In this embodiment, inserts 1005 in second inner row 1073 each have substantially the same negative offset distance 1013*a*.

As previously described, inserts 1005 in second inner row 1073 impact the formation in first direction 1050, whereas inserts 1005 in first inner row 1072 impact the formation in second direction 1051 that is opposite first direction 1050. To achieve the same angular orientation of inserts 1005 in first inner row 1072 upon impact with the formation as inserts 1005 in second inner row 1073, inserts 1005 in first inner row 1072 are preferably oriented to have an offset distance with the opposite sign convention as inserts 1005 in second inner row 1073. For example, if inserts 1005 in second inner row have an offset distance 1013*a* of −0.10 in., inserts 1005 in first inner row preferably have an offset distance of +0.10 in. Accordingly, as shown in FIG. 16, for each insert 1005 in first inner row 1072, an insert axis plane 1014*b* that contains central axis 1008 of and is parallel to cone axis 1022 does not contain cone axis 1022. Thus, central axis 1008 of each insert 1005 in first inner row 1072 is non-coplanar. Insert axis plane 1014*b* of each insert 1005 in first inner row 1072 is offset from a cone axis plane 1015*b*, that contains cone axis 1022 and is parallel to insert axis plane 1014*b*, by an offset distance 1013*b*. In this embodiment, offset distance 1013*b* is positive as each insert axis plane 1014*b* is ahead of or leads its corresponding cone axis plane 1015*b* relative to the cutting direction 1091 of cone cutter 1000 when the region between each insert 1005 in first inner row 1072 is viewed in top view. In this embodiment, inserts 1005 in first inner row 1072 each have substantially the same positive offset distance 1013*b*. In this embodiment, the absolute value and magnitude of offset distances 1013*a, b* are the same, however, the orientation of insert axis plane 1014*a, b* relative to cone axis plane 1015*a, b*, respectively, is different, and thus, the signs of offset distances 1013*a, b*, respectively, are opposites. In other embodiments, the magnitudes of the offset distances (e.g., offset distances 1013*a, b*) as well as the sign may be different. Further, although inserts 1005 are each symmetric inserts, in other embodiments, asymmetric inserts are oriented with opposite offset distances.

While preferred embodiments have been shown and described, modifications thereof can be made by one skilled in the art without departing from the spirit or teaching herein. The embodiments described herein are exemplary only and are not limiting. Although embodiments of bits described herein are preferably designed for soft to medium formations, they may also be employed in bits designed for medium and hard formation. Further, many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A rolling cone drill bit for drilling a borehole in earthen formations, the bit comprising:

a bit body having a bit axis;

a rolling cone cutter mounted on the bit body and adapted for rotation about a cone axis in a cutting direction;

at least one transition insert mounted to the cone cutter at a first radial position relative to the bit axis;

a first asymmetric insert mounted to the cone cutter at the first radial position or radially inward of the first radial position relative to the bit axis;

a second asymmetric insert mounted to the cone cutter at a second radial position that is radially outward of the first radial position relative to the bit axis wherein each of said first and second asymmetric inserts is symmetric about a first plane along the central axis of the insert, and wherein each of said first and second inserts is not symmetric about a second plane along said central axis of said insert, wherein said second plane is perpendicular to said first plane and is parallel to, or coplanar with, a third plane along the cone axis;

wherein each insert includes a base portion having a central axis and a cutting portion extending from the base portion and including a cutting surface; and wherein the cutting surface of the first asymmetric insert has a leading side relative to the cutting direction with a leading geometry and the cutting surface of the second asymmetric insert has a leading side relative to the cutting direction with a leading geometry that is different than the leading geometry of the first asymmetric insert, and wherein the first insert has a trailing side disposed 180° from the leading side of the first insert, and the second insert has a trailing side disposed 180° from the leading side of the second insert; and wherein the trailing side of the first insert has a first trailing geometry and the trailing side of the second insert has a second trailing geometry that is different from the first trailing geometry.

2. The rolling cone drill bit of claim 1 wherein the first asymmetric insert and the second asymmetric insert are each inner row inserts.

3. The rolling cone drill bit of claim 2 wherein the leading geometry of the leading side of the first insert is the same as the trailing geometry of the trailing side of the second insert, and the trailing geometry of the trailing side of the first insert is the same as the leading geometry of the leading side of the second insert.

4. The cone drill bit of claim 2, wherein the leading geometry of the first asymmetric insert is generally convex, and the leading geometry of the second asymmetric insert is generally concave.

5. The cone drill bit of claim 2, wherein the leading geometry of the first asymmetric insert is generally concave, and the leading geometry of the second asymmetric insert is generally convex.

6. The cone drill bit of claim 2, wherein the leading geometry of the first asymmetric insert and the trailing geometry of the second asymmetric insert are both generally convex, and the leading geometry of the second asymmetric insert and the trailing geometry of the first asymmetric insert are both generally concave.

7. The cone drill bit of claim 2, wherein the leading geometry of the first asymmetric insert and the trailing geometry of the second asymmetric insert are both generally concave, and the leading geometry of the second asymmetric insert and the trailing geometry of the first asymmetric insert are both generally convex.

8. The rolling cone drill bit of claim 2, wherein the central axis of the first asymmetric insert and the central axis of the second asymmetric insert are both non-coplanar with the cone axis.

9. The rolling cone drill bit of claim 2, wherein the central axis of the first asymmetric insert and the central axis of the second asymmetric insert are both coplanar with the cone axis.

10. The rolling cone drill bit of claim 2, wherein the first asymmetric insert is disposed in a first inner row and the second asymmetric insert is disposed in a second inner row that is axially spaced from the first inner row relative to the cone axis.

11. The rolling cone drill bit of claim 1 further comprising a first plurality of asymmetric inserts disposed in a first inner row and a second plurality of asymmetric inserts disposed in a second inner row that is axially spaced from the first inner row;

wherein the first asymmetric insert is disposed in the first inner row and the second asymmetric insert is disposed in the second inner row;

wherein the cutting surface of each asymmetric insert in the first inner row has a leading side relative to the cutting direction, and each asymmetric insert in the second inner row has a leading side relative to the cutting direction; and wherein the leading side of each asymmetric insert in the first inner row has a leading geometry that is the same; and wherein the leading side of each asymmetric insert in the second inner row has a leading geometry that is the same;

wherein the leading geometry of the asymmetric inserts in the first inner row is different than the leading geometry of the asymmetric inserts in the second inner row.

12. The rolling cone drill bit of claim 1, wherein each of said first and second asymmetric inserts comprises an elongated crest, said elongated crest being elongated along a direction of said second plane.

13. A method of orienting cutting elements on a cone cutter of a drill bit for drilling a borehole in earthen formations, the method comprising:

providing a bit body having a bit axis;

mounting a rolling cone cutter on the bit body, the rolling cone cutter adapted for rotation about a cone axis in a cutting direction;

inserting a plurality of inserts into the cone cutter, wherein the plurality of inserts are arranged in a plurality of circumferential rows that are axially spaced relative to the cone axis, wherein each insert has a base portion secured in a mating socket of the cone cutter and a cutting portion extending from the base portion, wherein the base portion has a central axis and the cutting portion has a cutting surface;

identifying a transition insert on the cone cutter, the transition insert being disposed at a first radial position;

wherein a first of the plurality of inserts is an asymmetric insert disposed at the first radial position or radially inward of the first radial position relative to the bit axis, and wherein a second of the plurality of inserts is an asymmetric insert disposed radially outward of the first radial position relative to the bit axis;

orienting the first of the plurality of inserts such that its cutting surface has a leading side relative to the cutting direction with a first geometry;

orienting the second of the plurality of inserts such that its cutting surface has a leading side relative to the cutting direction with a second geometry that is different than the first geometry, wherein each of said first of the plurality of inserts and each of said second of the plurality of inserts is symmetric about a first plane along the central axis of said insert, and wherein each of said first of the plurality of inserts and each of said second of the plurality of inserts is not symmetric about a second plane along said central axis of said insert, wherein said second plane is perpendicular to said first plane and is parallel to, or coplanar with, a third plane along the cone axis.

14. The method of claim 13 wherein the plurality of circumferential rows are inner rows.

15. The method of claim 14 wherein the cutting surface of the first of the plurality of inserts has a trailing side relative to the cutting direction with a third geometry that is different than the first geometry.

16. The method of claim 15 wherein the cutting surface of the second of the plurality of inserts has a trailing side relative to the cutting direction with a fourth geometry that is different than the second geometry.

17. The method of claim 16 wherein the first geometry and the fourth geometry are the same, and wherein the second geometry and the third geometry are the same.

18. The method of claim 14, wherein the identifying the transition insert comprises:

extending a line from the intersection of the bit axis and the cone axis in rotated profile view; and rotating the line until the line touches the cutting surface of one of the inserts mounted to the cone cutter without intersecting the profile of any other insert mounted to the cone cutter.

19. The method of claim 14 further comprising orienting the first of the plurality of inserts such that its central axis does not lie in a common plane with the cone axis.

20. The method of claim 19 further comprising orienting the second of the plurality of inserts such that its central axis lies in a common plane with the cone axis.

21. The method of claim 19, wherein each of said first and second asymmetric inserts comprises an elongated crest, said elongated crest being elongated along a direction of said second plane.

22. A rolling cone drill bit for drilling a borehole in earthen formations, the bit comprising:

a bit body having a bit axis;

a rolling cone cutter mounted on the bit body and adapted for rotation about a cone axis in a cutting direction;

at least one transition insert mounted to the cone cutter at a first radial position relative to the bit axis;

a first insert having a central axis and being mounted to the cone cutter at the first radial position or radially inward of the first radial position relative to the bit axis;

wherein the central axis of the first insert defines is along a first insert axis plane that is parallel to the cone axis, wherein the cone axis defines is along a first cone axis plane that is parallel to the first insert axis plane, and wherein the first insert axis plane is offset from the first cone axis plane by a first offset distance measured perpendicularly therebetween;

a second insert having a central axis and being mounted to the cone cutter radially outward of the first radial position relative to the bit axis;

wherein the central axis of the second insert defines is along a second insert axis plane that is parallel to the cone axis, wherein the cone axis defines is along a second cone axis plane that is parallel to the second insert axis plane, and wherein the second insert axis plane is offset from the second cone axis plane by a second offset distance measured perpendicularly therebetween;

wherein the first offset distance is different than the second offset distance.

23. The rolling cone drill bit of claim 22 wherein the first insert and the second insert are both inner row inserts.

24. The rolling cone drill bit of claim 23 wherein the first offset distance is positive and the second offset distance is negative.

25. The rolling cone drill bit of claim 24 wherein the absolute value of the first offset distance is the same as the absolute value of the second offset distance.

26. The rolling cone drill bit of claim 23 wherein the first offset distance is negative and the second offset distance is positive.

27. The rolling cone drill bit of claim 26 wherein the absolute value of the first offset distance is the same as the absolute value of the second offset distance.

28. The rolling cone drill bit of claim 23 wherein the first insert and the second insert are both symmetric inserts.

* * * * *

UNITED STATES PATENT AND TRADEMARK OFFICE

CERTIFICATE OF CORRECTION

PATENT NO. : 8,281,881 B2
APPLICATION NO. : 12/401104
DATED : October 9, 2012
INVENTOR(S) : Luca Tedeschi It is certified that error appears in the above-identified patent and that said Letters Patent is hereby corrected as shown below:

In the Claims

| | |
|---|---|
| Column 22, Claim 22, line 9 | Delete "defines" |
| Column 22, Claim 22, line 11 | Delete "defines" |
| Column 22, Claim 22, line 19 | Delete "defines" |
| Column 22, Claim 22, line 21 | Delete "defines" |

Signed and Sealed this
Fifteenth Day of October, 2013

Teresa Stanek Rea
*Deputy Director of the United States Patent and Trademark Office*